US005822894A

United States Patent [19]

Ohsugi

[11] Patent Number: 5,822,894

[45] Date of Patent: Oct. 20, 1998

[54] INVERTIBLE IRONING BOARD

[75] Inventor: Yasuhiro Ohsugi, Hiroshima, Japan

[73] Assignee: NKG Co., Ltd., Hiroshima, Japan

[21] Appl. No.: 730,848

[22] Filed: Oct. 17, 1996

[30] Foreign Application Priority Data

| | | | |
|---|---|---|---|
| Oct. 28, 1995 | [JP] | Japan | 7-012799 U |
| Oct. 28, 1995 | [JP] | Japan | 7-012800 U |
| Oct. 28, 1995 | [JP] | Japan | 7-315722 |
| Jan. 8, 1996 | [JP] | Japan | 8-000948 |
| Jan. 17, 1996 | [JP] | Japan | 8-006014 |

[51] Int. Cl.[6] ..... D06F 81/02; D06F 85/00

[52] U.S. Cl. ..... 38/136; 38/108; 38/140

[58] Field of Search ..... 38/12, 13, 4, 66, 38/103, 108, 111, 135–141

[56] References Cited

U.S. PATENT DOCUMENTS

| | | | |
|---|---|---|---|
| 533,793 | 2/1895 | Doyle | 38/108 |
| 876,410 | 1/1908 | Stone | 38/140 |
| 914,956 | 3/1909 | Kenan | 38/137 X |
| 1,059,778 | 4/1913 | Solomon | 38/140 X |
| 1,662,748 | 3/1928 | Johnson . | |
| 1,789,638 | 1/1931 | Pullman et al. | 38/136 X |
| 2,008,596 | 6/1935 | Salmon . | |
| 2,257,146 | 9/1941 | Zirker et al. | 38/141 X |
| 2,261,894 | 11/1941 | Zammitti | 38/137 X |
| 2,287,645 | 6/1942 | Spencer . | |
| 2,470,516 | 5/1949 | Neckel | 38/13 |
| 2,610,418 | 9/1952 | Lantz | 38/140 |
| 2,663,958 | 12/1953 | Keast . | |
| 2,939,233 | 6/1960 | Munson | 38/139 |
| 3,064,373 | 11/1962 | Spain | 38/138 X |
| 3,667,142 | 6/1972 | Doodloe et al. . | |
| 5,016,367 | 5/1991 | Breen et al. . | |

FOREIGN PATENT DOCUMENTS

| | | | |
|---|---|---|---|
| 458 503 | 11/1991 | European Pat. Off. . | |
| 1 499 962 | 1/1968 | France . | |
| 97442 | 5/1897 | Germany . | |
| 76 520 | 11/1954 | Netherlands . | |
| 192 558 | 11/1937 | Switzerland . | |
| 298850 | 8/1954 | Switzerland | 38/136 |
| 2578 | 11/1910 | United Kingdom . | |
| 1 411 437 | 10/1975 | United Kingdom . | |

*Primary Examiner*—Ismael Izaguirre
*Attorney, Agent, or Firm*—Darby & Darby

[57] ABSTRACT

An ironing board in which two pressing portions supported to both ends of a pole have their own pressing surfaces on the sides opposite to the pole, respectively, the width of one pressing surface can be increased and reduced, an auxiliary pressing portion with a convex pressing surface can be installed and removed in and from one pressing portion, and a retainer member for restraining an ironed substance is equipped. With this configuration, various types of pressing surfaces can be diverted with simple operation, and iron-pressing can be carried out without displacing the ironed substance, thereby achieving improved ironing efficiency.

23 Claims, 28 Drawing Sheets

INVERTIBLE IRONING BOARD

BACKGROUND OF THE INVENTION

Field of the Invention

The present invention relates to an ironing board, and particularly, to an ironing board which enables the use of a pressing surface with suitable form or area in accord with an ironed substance or to an ironing board that can improve ironing efficiency when ironing.

DESCRIPTION OF THE PRIOR ART

Ironing is carried out, for example, by placing the substance to be pressed such as garments on an ironing board and rubbing and moving an iron while pressing it from above the ironed substance. Pressing can smooth down wrinkles of the ironed substance. The ironed substance varies in size and form, and even one piece of garment, portions to be ironed vary in size and form, such as shoulders, collars, and sleeves. To cope with ironed substances with varying sizes and forms in this way, ironing boards with different pressing surface areas, and plane type, convex type, and glove type ironing boards are commercially available.

For example, for sheets, body of garments, etc. which need pressing on a plane, a plane type ironing board is used, while for caps, shoulders of garments, etc. which need pressing on a convex form, a convex type ironing board is used. When only part of the ironed substance is pressed, a glove type ironing board whose surface is used for the pressing surface is worn on a hand and the pressing surface is applied to the ironed substance to enable iron-pressing conveniently. In this way, by properly using ironing boards in accord with the shape of the ironed substance, various substances to be ironed can be easily and dexterously iron-pressed. However, there are problems in that purchasing so many ironing boards at home is costly and a wide space is required for storing these ironing boards. In addition, there is another problem in that even when a wide variety of ironing boards are purchased, it is troublesome and time consuming to replace ironing boards in accordance with the type of ironed substance.

When iron-pressing ironed substances with varying sizes, replacing and using ironing boards with the pressing surface area suited for relevant sizes achieves easy and dexterous iron-pressing. However, as described above, it takes time to replace ironing boards 30 and the same ironing board is kept in use. Consequently, for example, if an ironing board with a small pressing surface area is used to iron-press the large ironed substance such as bed sheets, the sheets must be moved many times on the ironing board until the whole area is iron-pressed. As a result, it takes a great deal of labor and time, creating a problem in that new wrinkles are generated because the ironed substance is moved.

In addition, when iron-pressing is carried out, the ironed substance moves as the iron moves. As a result, there is a problem in which new wrinkles are generated on the ironed substance. Using an iron press, it is possible to crease clothing, for example, slacks, pleated skirts, etc. For example, when the ironed substance is creased, it is possible to easily and quickly produce desired creases by pressing both ends of the creased portion of the ironed substance. However, since one hand holds an iron during iron-pressing, the ironed substance is pressed with only the other hand, and it is difficult to provide desired creases. Even if the desired crease is provided, there is a problem in that it requires quite an effort or extra time.

SUMMARY OF THE INVENTION

In view of the foregoing, it is the main object of this invention to provide an ironing board which can improve the ironing efficiency and reduce power consumption as a result of reduction in pressing time by including a first pressing portion and a second pressing portion to be equipped on both ends with an pressing surface on the side opposite to a pole, respectively, as well as by having a pressing surface whose area can be adjusted.

The ironing board according to this invention comprises a first pressing portion and a second pressing portion, both having pressing surfaces to be in contact with the ironed substance, and a pole supporting the first and the second pressing portions at both ends thereof, wherein the first pressing portion and the second pressing portion have their respective pressing surfaces on the side opposite to the pole.

Consequently, one ironing board has two pressing portions and it is possible to use either of the pressing portions as the top by inverting the ironing board. In this event, the pressing portion on the bottom serves as a support. Since two pressing portions are supported with a pole, a space is provided at the lower part of the upper pressing portion. With this configuration, it is possible to insert a ring-form ironed substance, such as a sleeve or waist of slacks into the top pressing portion and iron-press the ironed substance on the pressing surface without wrinkling the ironed substance located at the lower part of the pressing portion.

The ironing board according to this invention is characterized by the first pressing portion comprising a pressing surface of smaller area than the second pressing portion, wherein the first pressing portion includes supporting legs for supporting the second pressing portion when the iron board is inverted.

Consequently, because the pressing surface of the first pressing portion has an area smaller than that of the pressing surface of the second pressing portion, the support of the ironing board is reinforced by using supporting legs when the first pressing portion is located on the bottom.

In addition, the ironing board according to this invention is characterized by the first pressing portion comprising two supporting legs, storing chambers concavely provided on opposite sides for storing the respective supporting legs, and a shaft for rotatably pivoting the base portion of the supporting legs in the storing chambers so that the supporting legs emerge from the respective storing chambers.

Consequently, when the first pressing portion is located on the bottom side, the supporting legs are pulled out from the storing chambers by rotation and the leg bottom surfaces at the tip ends of the supporting legs are brought in contact with the floor surface to stably support the ironing board. When the first pressing portion is located on the top side, the supporting legs are housed in the storing chambers by rotation for efficiently carrying out ironing work.

Furthermore, the ironing board according to this invention is characterized by a pressing portion comprising a pressing surface to be brought in contact with the ironed substance, wherein the area of the pressing surface is able to be increased and reduced.

Consequently, since it is possible to vary the area with only one pressing surface of one ironing board, it is possible to properly and easily use the pressing surface in accordance with the size of the ironed substance.

Furthermore, the ironing board according to this invention is characterized by the pressing portion comprising a base plate having a column and a first engaging member, a pressing plate supported by the column and constituting the pressing surface, and width adjusting plates pivoted on either side of the pressing plate, respectively, formed convexly outwards, rotatable in the direction in which both tip end portions open and close, and having a second engaging member to be engaged with the first engaging member, wherein the engagement of the first and the second engaging members stops rotation in the direction in which the tip end portions of the both width adjusting plates open.

Consequently, it is possible to add part of the width adjusting plate to the pressing surface by rotating the width adjusting plate of the pressing portion in the opening direction and by stopping the rotation in the closing direction, whereby the area of the pressing surface can be increased. Since only rotating the width adjusting plate can increase or reduce the area of the pressing surface, the pressing surface can be easily diverted in accord with the size of the ironed substance. The ironing board can be stored in a narrow space by storing it with the area of the pressing surface held to the minimum.

Furthermore, the ironing board according to this invention is characterized by the pressing portion comprising, a base plate having a column and the first engaging member, a pressing plate supported by the column and constituting the pressing surface, and width adjusting plates pivoted on either side of the pressing plate, respectively, formed concavely outwards, rotatable in the direction in which both the tip end portions open and close, and having a second engaging member to be engaged with the first engaging member, wherein the engagement of the first and the second engaging members stops rotation in the direction in which the tip end portions of the both the width adjusting plates close.

Consequently, it is possible to define the rotating angle of the width adjusting plates by rotating the width adjusting plates of the pressing portion in the opening direction and by stopping its rotation, and it is also possible to prevent excessive opening of the width adjusting plate. With this configuration, the area of the pressing portion can stably be increased.

Another object of this invention is to provide an ironing board in which the ironing efficiency can be improved and power consumption can be reduced as a result of reduction in ironing time by removably fitting an auxiliary pressing portion with a convex face.

The ironing board according to this invention comprises a pressing portion with a pressing surface which is brought in contact with the ironed substance and an auxiliary pressing portion to be removably equipped with the pressing portion and having a convex face portion.

Consequently, both plane pressing surface and convex pressing surface can easily be diverted by fitting or removing the auxiliary pressing portion with a convex face portion.

The ironing board according to this invention comprises a pressing portion, the pressing portion being provided with a hook, and an auxiliary pressing portion providing a latching portion to be engaged with the hook.

Consequently, by engaging, for example, a loop-like latch which the auxiliary pressing portion is provided with to the hook of the pressing portion, the auxiliary pressing portion is fitted to the pressing portion and the auxiliary pressing portion is removed by disengaging the loop from the hook.

Furthermore, the ironing board according to this invention is characterized by the auxiliary pressing portion comprising the convex face portion and a flat reverse portion and formed into a bag shape with one side allowed to open.

Consequently, it is possible to conveniently and easily iron-press the ironed substance by removing the bag-shape auxiliary pressing portion from the pressing portion and putting it on a hand, and applying the convex-form face portion to a part to be pressed of the ironed substance.

Furthermore, the auxiliary pressing portion according to this invention comprises a convex face portion constituting one surface of the bag, one side of which is allowed to open, a flat reverse portion constituting the other surface of the bag, and a latching portion to engage with a hook provided at the pressing portion to be brought in contact with an ironed substance.

Consequently, when the auxiliary pressing portion is consumed by contamination, breakage, etc., it is possible to remove this and using the ironing board by fitting a new auxiliary pressing portion.

Another object of this invention is to provide an ironing board which can restrain the ironed substance together with a retainer member and one hand by providing a retainer member for pressing the ironed substance.

The ironing board according to this invention comprises a pressing portion with an pressing surface to be brought in contact with the ironed substance and a retainer member for restraining the ironed substance by part of the ironed substance against the pressing portion.

Consequently, the retainer member restricts part of the ironed substance and one hand presses the other side so that both sides of the ironed substance are pressed, and even when an iron moves in any direction, the ironed substance will not move together with the iron. Pleats and creases can be easily formed because both sides can be fixed.

The ironing board according to this invention is characterized by the retainer member which presses the ironed substance by elasticity. Consequently, no cost is required for restraining the ironed substance while ironing, and the retainer member is easy to operate to restrain the ironed substance.

In addition, the ironing board according to this invention is characterized by a pole for supporting the pressing portion, the retainer member being pivotally supported to the pole, the retainer member having a retainer plate formed in a concavely curved shape with opposite side of the pole, and having a retainer surface in contact with the ironed substance on the opposite side, and an elastic member which is coupled between the retainer plate and the pole, and providing the retainer surface with a pressing force in the direction approaching to the surface opposite to the retainer surface of the pressing portion.

Consequently, it is possible to press both sides of the ironed substance by allowing the pressure member to restrain part of the ironed substance and one hand to press the other side, thereby pressing both sides of the ironed substance. Since the retainer member is fitting to the pole, operation to allow the retainer member to restrain the ironed substance is easy.

Furthermore, the ironing board according to this invention is characterized by the retainer plate comprising a bracket located on the opposite side, which is rotatably pivoted in such a manner that the retainer surface moves in the direction of the pressing force, and the pole portion comprises a bracket coaxially pivoted with the bracket of the retainer plate.

Consequently, because only by coaxially pivoting the brackets of the pole and the retainer plate and connecting the elastic member to the pole and the retainer plate, the retainer member can be fitted, the construction is simple.

Still another object of this invention is to provide an ironing board in which a cushioning portion on the surface of a pressing core bed constituting a pressing portion is removably fitted to enable renewing of the cushioning portion.

The ironing board according to this invention comprises a pressing portion which brings the ironed substance in contact, wherein the pressing portion comprises a pressing core bed and a cushioning portion having elasticity and removably fitted to the surface of the pressing core bed utilizing the elasticity.

The ironing board according to this invention comprises a pressing portion which brings the ironed substance in contact, wherein the pressing portion comprises a pressing core bed equipped with hooks on the outer circumference and a cushioning portion removably fitted to the pressing core bed by proving holes engaged with the hooks.

In addition, the cushion portion according to this invention comprises holes engaged to the hooks provided in the pressing core bed constituting the pressing portion.

Consequently, it is possible to detach obsolete cushioning portion and fit a new cushion portion. Because the cushioning portion provides elasticity, the cushioning portion does not generate wrinkles and is able to be securely fitted to the pressing core bed.

The above and further objects and novel features of the invention will more fully be apparent from the following detailed description with accompanying drawings.

DETAILED DESCRIPTION OF THE INVENTION

Referring now to drawings showing embodiments, this invention will be described in detail hereinafter.

Figure 1:
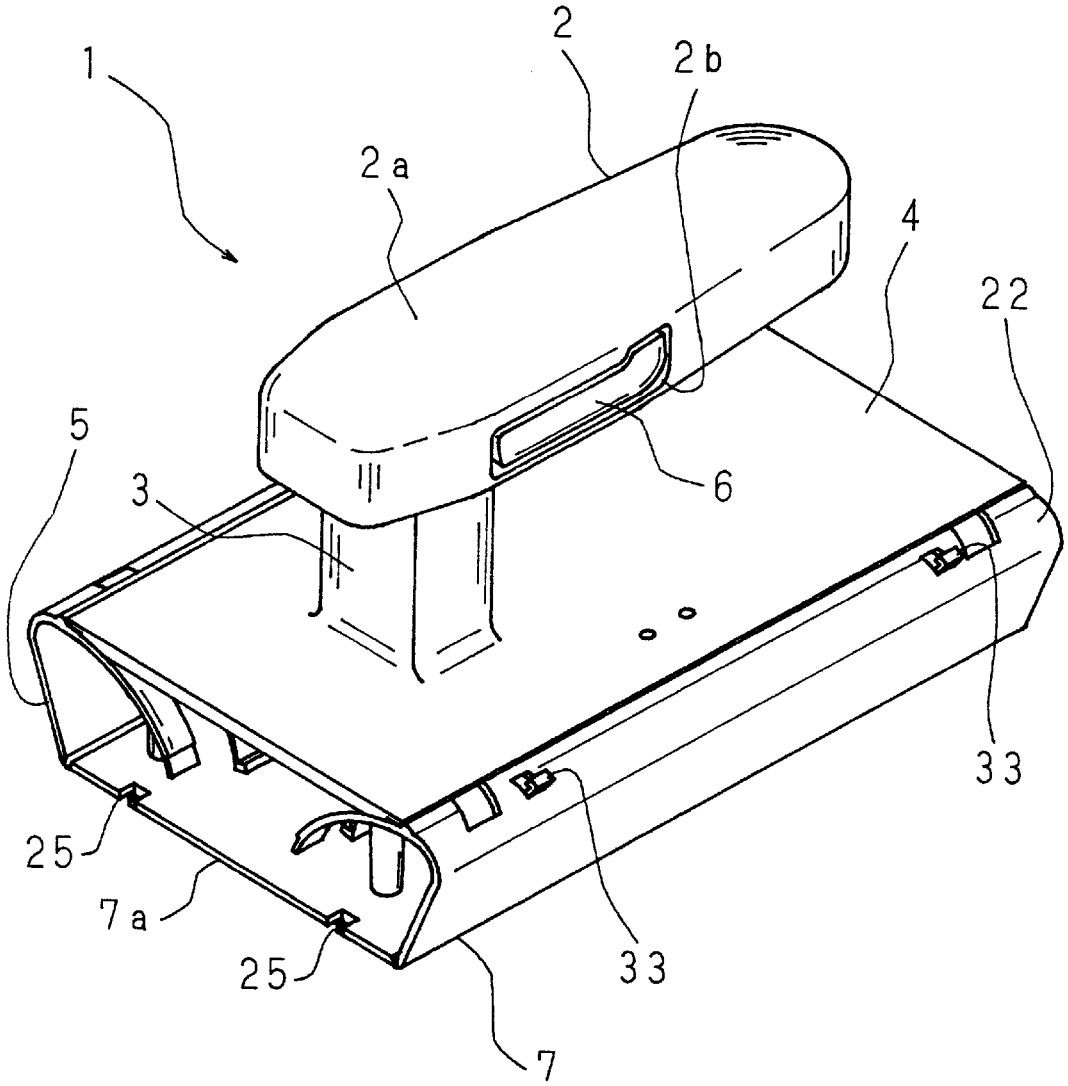
FIG. 1 is a perspective view showing the construction of an ironing board of the first embodiment according to the present invention.

FIG. 1 is a perspective view showing the construction of the ironing board of the first embodiment according to this invention. As shown in the drawings, the ironing board 1 is constructed by mounting erect a pole 3 little closer to one longitudinal side on a large pressing portion 7 in the form of flat rectangular parallelepiped and supporting a small pressing portion 2 at the top of the pole 3. The small pressing portion 2 is of a form of plasterer trowel as seen on the plane, that is, of a flat plate form in which one longitudinal side is angular and the other side is round and narrow in width, and on a base made of synthetic resin such as ABS resin (Acrylonitrile-Butadiene-Styrene resin), polyurethane sheet with cushioning capability is placed, the surface is covered with cotton twill fabric, and a small pressing surface 2*a* is formed on the top surface of the small pressing portion 2. The bottom surface of the one angular side of the small pressing portion 2 is supported with the pole 3 and the rounded edge of the small pressing portion 2 is located on the upper part of the other side of the large pressing portion 7 for from the pole 3.

As shown in FIG. 1, when the ironing board 1 is placed with the small pressing surface 2*a* above, a large pressing surface 7*a* of the surface of the large pressing portion 7 is located at the bottom, while when the ironing board 1 is inverted and placed with the large pressing surface 7*a* above, the small pressing surface 2*a* is located at the bottom. The pressing surface 7*a* is used covered with sheet with cushioning capability, but the drawing shows the condition with this sheet removed to better illustrate the construction of the large pressing portion 7.

Figure 2:
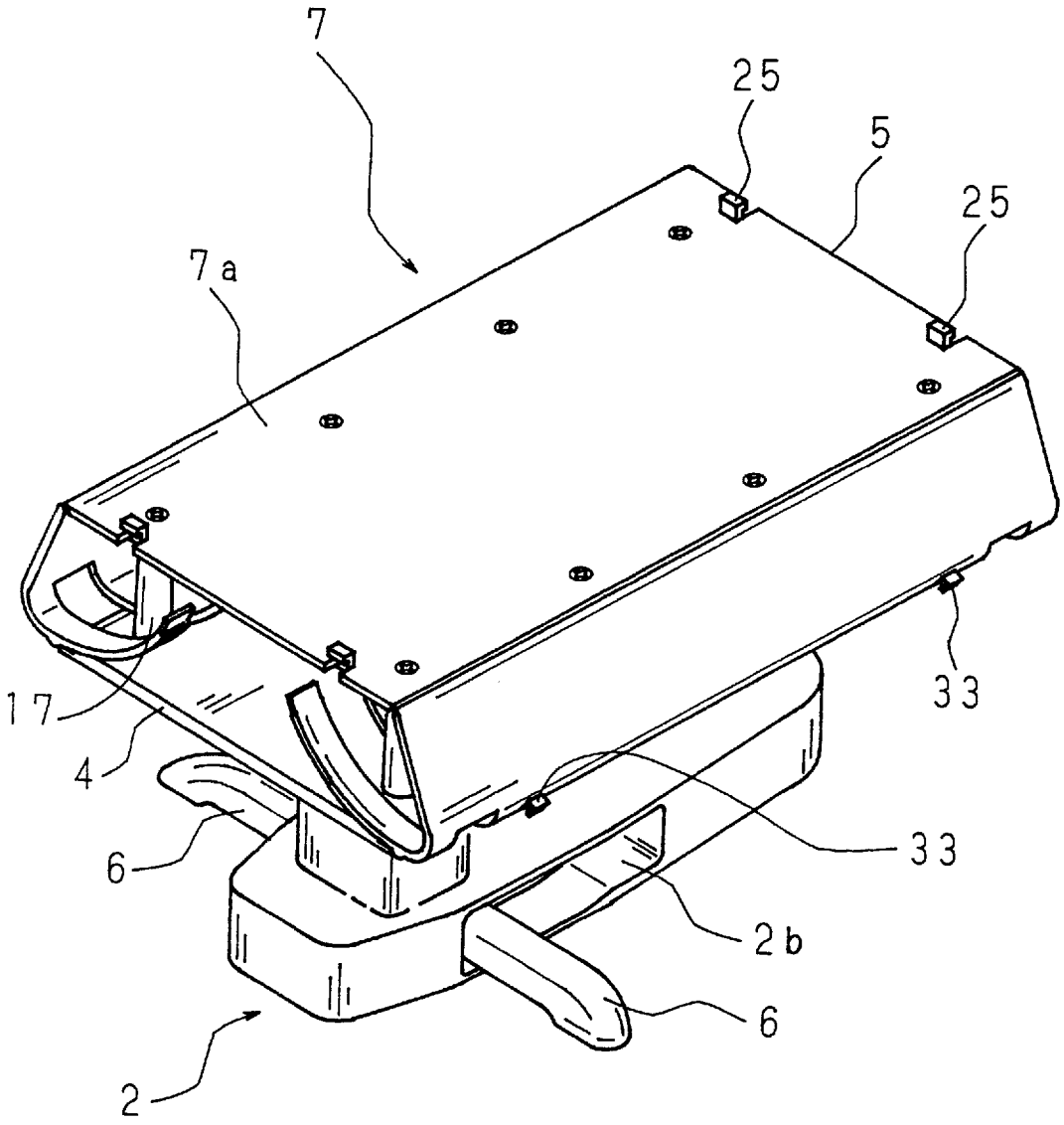
FIG. 2 is a perspective view showing the inverted condition of the ironing board of the first embodiment.
Figure 3:
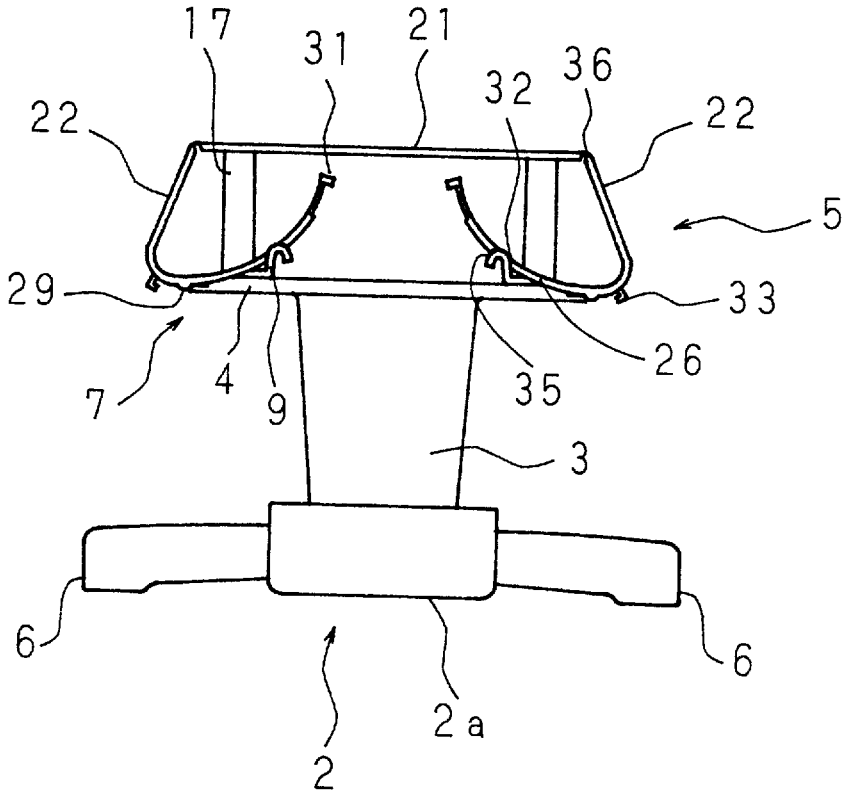
FIG. 3 is a side view showing the ironing board shown in FIG. 2 as seen from the longitudinal direction.
Figure 4:
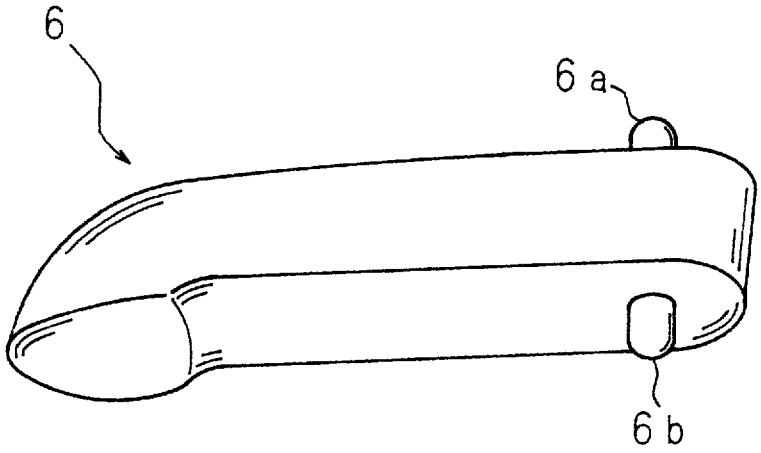
FIG. 4 is a enlarged perspective view showing the construction of the auxiliary leg of the first embodiment.
Figure 5:
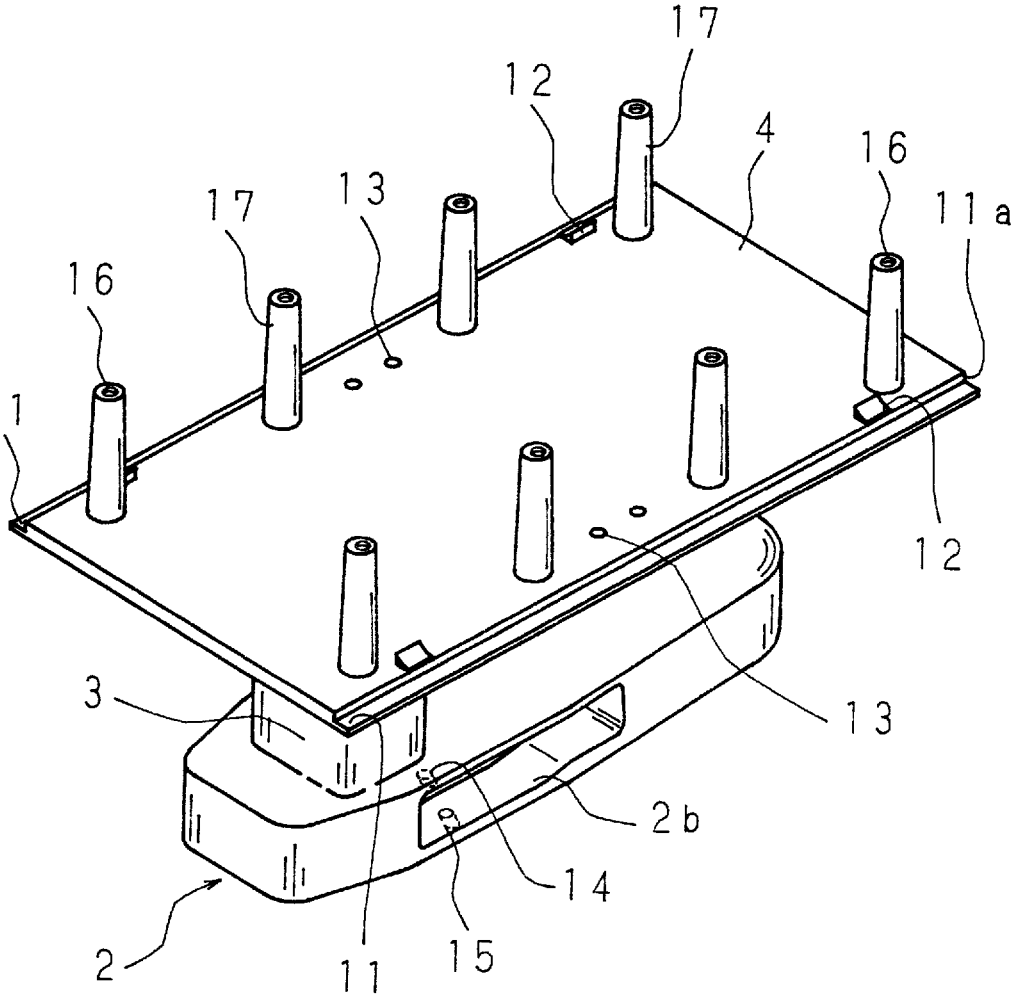
FIG. 5 is a perspective view of the condition in which the lid plate and auxiliary legs of the ironing board of the first embodiment are removed.

FIG. 2 is a perspective view showing the condition in which the ironing board 1 of the first embodiment is inverted, wherein FIG. 3 is a side view of the ironing board 1 of the first embodiment as seen from the longitudinal direction. FIG. 4 is an enlarged perspective view showing the construction of the auxiliary leg 6, while FIG. 5 is a perspective view of the ironing board 1 with the lid plate 5 and the auxiliary leg 6 removed.

As shown in FIG. 2, on the front and the rear surface of the small pressing portion 2, storing chambers 2*b*, 2*b* of the size and shape in which auxiliary legs 6, 6 are stored are concavely provided little towards the angular side, respectively. As shown in FIG. 5, on the top and bottom surfaces little towards the angular side inside the storing chamber 2*b*, fixing holes 14, 15 for fitting both tip ends of a shaft are provided. The fixing holes 14, 15 are same in the axial direction, respectively, and formed at a gradient in which the bottom portion of the fixing hole 14 is located on the angular side of the small pressing portion 2, and the bottom of the fixing hole 15 is located on the round side.

The auxiliary legs 6 are formed integrally with ABS resin, and as shown in FIG. 4, one bar-form end (tip end) is bent to one side to form the leg bottom, and shafts 6*a*, 6*b* are protruded on the side same as and opposite to the leg bottom of the other end (base end). The auxiliary leg 6 is pivotally supported around the shafts 6*a*, 6*b* by fitting the shafts 6*a*, 6*b* into the fixing holes 14, 15, enabling them to rotate in the range from the direction of the storing chamber 2*b*, that is, longitudinal direction of the small pressing portion 2 to the lateral direction. Because the fixing holes 14, 15 possess a gradient as described above, the auxiliary legs 6 has the leg bottom surface at the tip end becomes lower than the storing position and achieves the same height to that of the small pressing surface as shown in FIG. 3 when the auxiliary leg is pulled out from the storing chambers 2*b*, 2*b*, and the leg bottom surface comes in contact with the floor surface and is able to stably support the ironing board 1. The auxiliary legs 6, 6 are designed to be pulled out from the storing chamber 2*b* to support the ironing board 1 when the small pressing portion 2 is located on the bottom side, while they are designed to be stored in the storing chamber 2*b* when the small pressing portion is located above.

The base plate 4 with the pole 3 provided on the surface is a rectangular shape as seen from the plane, and as shown in FIG. 2, the large pressing portion 7 is formed by fixing the lid plate 5 to the columns 17, 17 provided erectly on the reverse surface (top surface shown in FIG. 2) of the base plate 4. As shown in FIG. 5, at both end portions in the lateral direction on the reverse surface of the base plate 4, fixing steps 11, 11 with thinner thickness with thick-level difference provided on the reverse surface are provided, and a step side surface 11*a* is possessed at the boundary of thick-level differences. Columns 17, 17 for supporting the lid plate 5 are mounted erectly four pieces each at nearly equal spaces in two lines at both the end portions of the reverse surface of the base plate 4, and on the top portion of the columns 17, 17, screw holes 16, 16 are, respectively formed. In the vicinity of the columns 17, 17 of the line end, four taper fixing portions 12, 12 are formed with the center side held higher on the inside from the fixing steps 11, 11. At the nearly longitudinal center of the reverse surface of the base plate 4, screw holes 13, 13 for mounting locking plates are formed inside from the fixing steps 11, 11.

Figure 6:
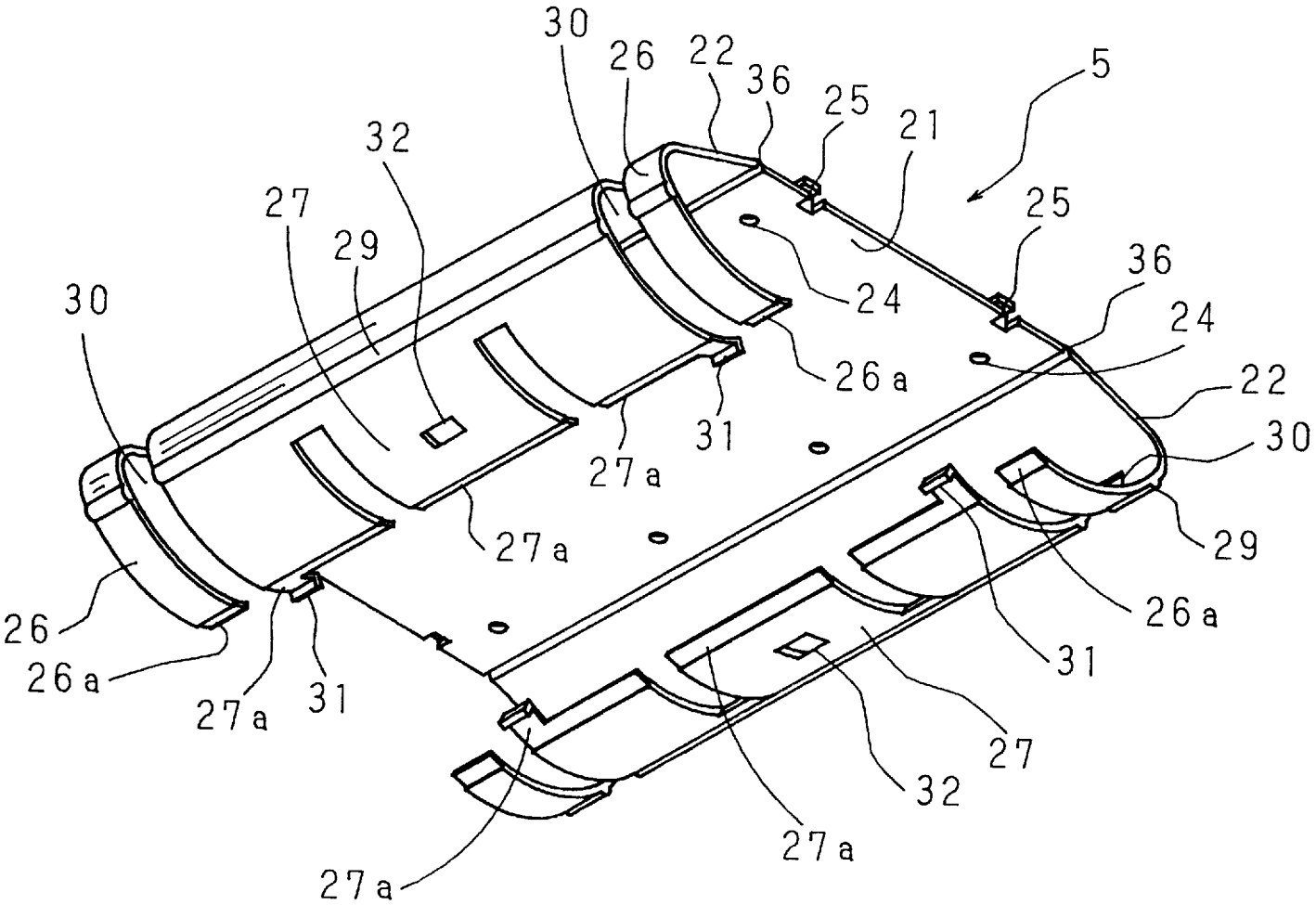
FIG. 6 is a perspective view showing the construction of the lid plate of the first embodiment.

FIG. 6 is a perspective view showing the construction of the lid plate 5. The lid plate 5 is made of synthetic resin such as PP (polypropylene resin), and is equipped with a nearly rectangular shell plate 21 and width adjusting portions 22, 22 with U-letter form side section along the lateral direction integrally formed in both ends of the lateral direction of the shell plate 21. The width adjusting portion 22 has one end portion of the U-letter shape is connected to the lateral end portion of the shell plate portion 21, while both width adjusting sections 22, 22 are formed in such a manner that the U-letter shaped apertured portion is held opposite to each other. The boundary portion between the shell plate portion 21 and the width adjusting portions 22, 22 is formed thinly, and the width adjusting portions 22, 22 are designed to be rotated with the boundary portion (hinge portions 36, 36) used as an axis.

To the shell plate portion 21, eight holes 24, 24 for screwing to columns 17, 17 are formed in two lines on both ends in the lateral direction at the position corresponding to the screw holes 16, 16 of the columns 17. The shell plate portion 21 has two cut riser pawls 25, 25 at predetermined lateral intervals at the both longitudinal end portions, respectively. The cut riser pawls 25, 25 are formed with the tip end directed outwards.

The width adjusting portions 22, 22 has four circumferential notches provided at the edges opposite to the hinge portions 36, 36, that is, at the tip end portion of the lid plate 5. The two notches provided at both lateral end portions along the hinge portions 36, 36 are longer than the two notches provided at the center portion and are provided from the position closer to the hinge portions 36 than the U-letter bottom portion, and form pull-out apertures 30, 30, and form branching pieces 26, 26 at both lateral end portions of the width adjusting portion 22 and form a lock portion 27 at the center portion. The lock portion 27 is branched into three portions at the tip end with two notches. On the outer circumferential surface of the width adjusting portion 22, a linear fixing protrusion 29 extending in the lateral direction is protrudently provided in the position closer to the tip end portion rather than the U-letter bottom portion.

At the tip end portions of the branching pieces 26, 26 and the locking portion 27, there formed are fixing steps 26*a*, 26*a*, 27*a*, 27*a*, 27*a* with a thick-level difference provided in the outer circumferential surface to reduce thickness. At the tip end of the fixing steps 27*a*, 27*a* on both sides branched into three, the locking portion 27 has locking pawls 31, 31 protruding on the outer circumferential surface side are formed at shorter width than the fixing step 27*a*, and between the fixing step 27*a* at the branched center and the fixing protrusion 29, there formed is a rectangular-form locking holes 32. At the position closer to the hinge portion 36 than the U-letter bottom portion of the locking portion 27, cut riser pawls 33, 33 are formed at predetermined intervals and the tip ends of the cut riser pawls 33, 33 are directed to the U-letter bottom portion. The width adjusting portions 22, 22 configured as described above are formed in such thickness and notch size that enable the width adjusting portions 22, 22 have suitable elasticity.

Figure 7:
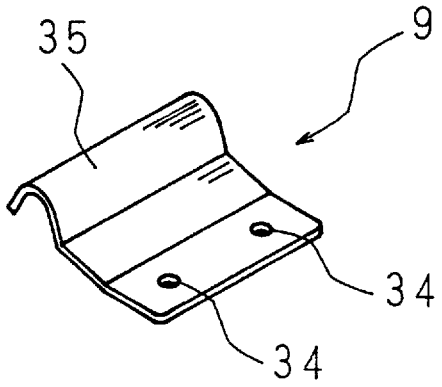
FIG. 7 is an enlarged perspective view showing the construction of locking plate spring of the first embodiment.

FIG. 7 is an enlarged perspective view showing the construction of the locking plate spring. As shown in FIG. 7 the locking plate spring 9 is a rectangular plate spring as seen on the plane, and has holes 34, 34 on one side and a latching piece 35 with elasticity with the top side bent in the convex form on the other side. The locking plate springs 9 are mounted to the base plate 4 by driving screws through the holes 34 and screw holes 13, respectively. The latching piece 35 is formed in such a size and bend that the locking hole 32 of the lid plate 5 fits in the convex surface to exhibit latching effects.

In the large pressing portion 7 configured as described above, fixing protrusions 29, 29 of the lid plate 5 come in contact with the lateral edge portion of the base plate 4, and the locking holes 32, 32 of the locking portion 27, 27 fit into the latching pieces 35, 35, and rotation of the width adjusting portions 22, 22 is locked to stand still in both opening and closing directions.

Figure 8:
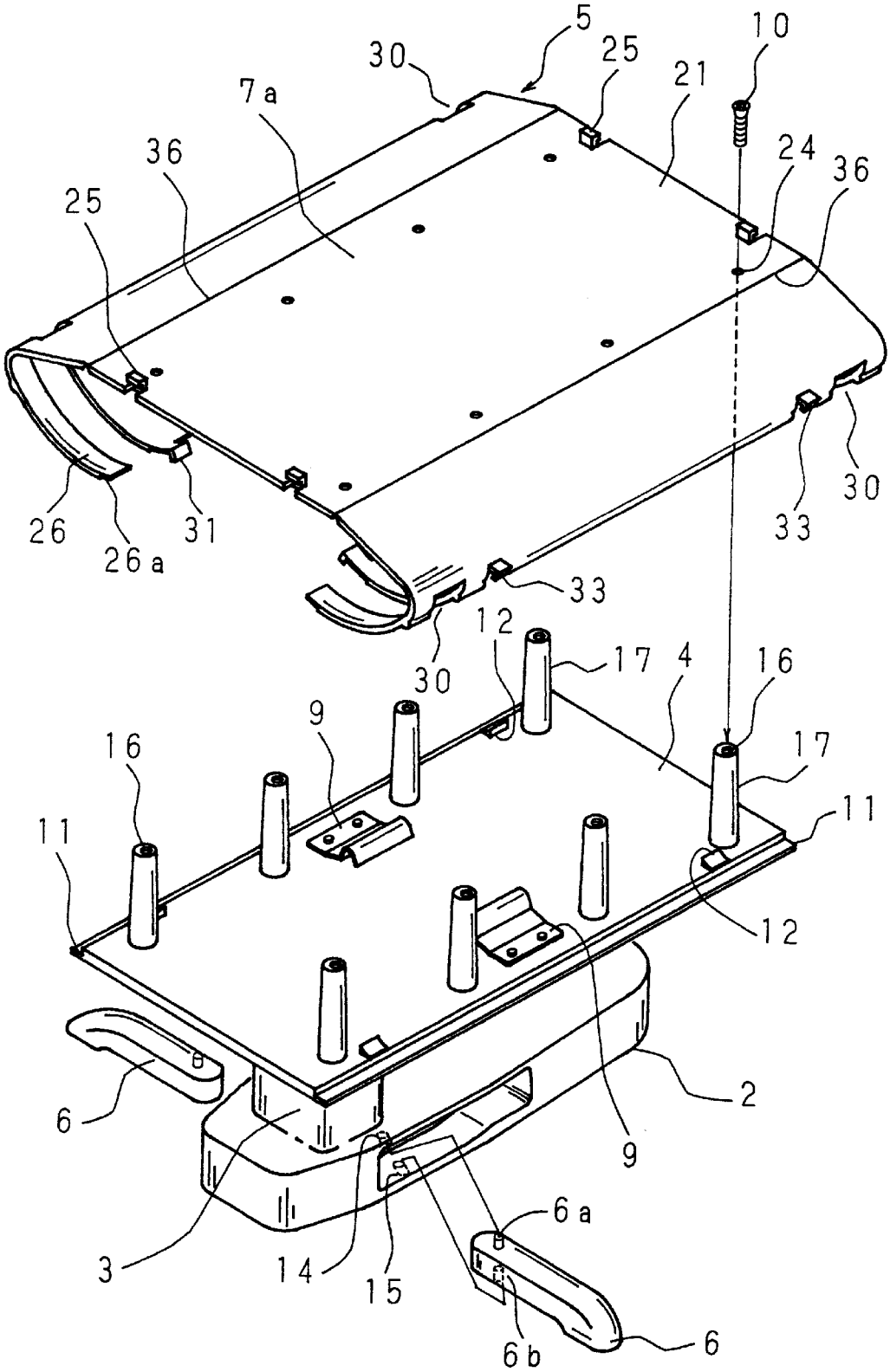
FIG. 8 is an explanatory drawing for assembling the lid plate and auxiliary legs of the first embodiment into an ironing board.

FIG. 8 is an explanatory drawing to assemble the lid plate 5 and auxiliary legs 6, 6 into the ironing board 1. As shown in FIG. 8, when auxiliary legs 6 are mounted, shafts 6*a*, 6*b* are fitted into the fixing holes 14, 15 respectively. When the lid plate 5 is mounted, the longitudinal direction of the lid plate 5 is aligned to the longitudinal direction of the base plate 4, the screws 10 is passed holes 24, 24 of the shell plate portion 21 to fit into the screwing holes 16, 16 of columns 17, 17, and the lid plate 5 and columns 17, 17 are fixed by screwing, respectively. With this operation, the auxiliary legs 6, 6 rotate around the shaft 6*a*, 6*b* to support the large pressing portion 7, and the lid plate 5 allows the respective width adjusting portions 22, 22 to rotate around the hinge portions 36, 36 to adjust the width of the large pressing surface 7*a*.

Figure 9:
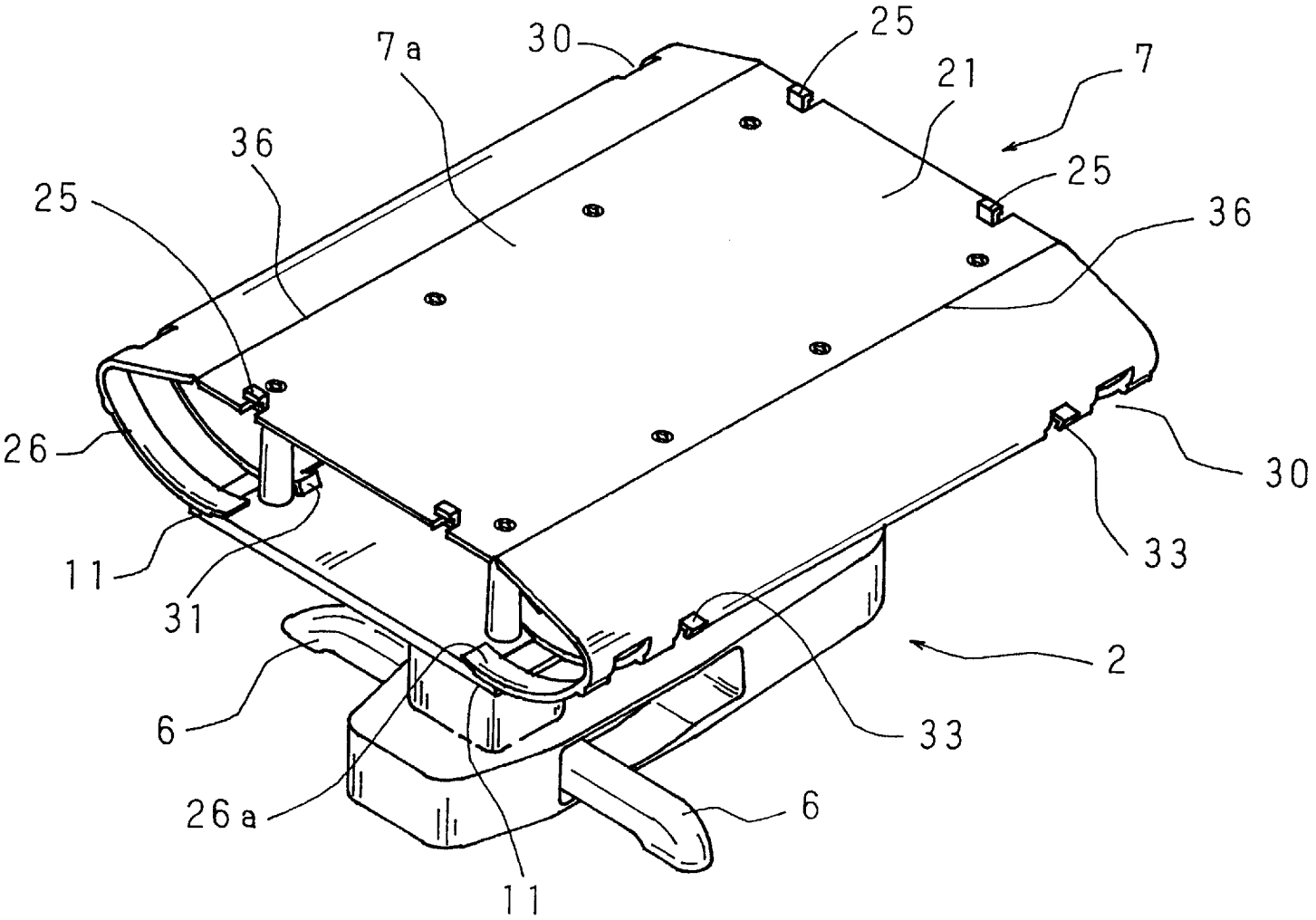
FIG. 9 is a perspective view showing the condition in which the area of a large pressing surface of the ironing board shown in FIG. 2 is increased.
Figure 10:
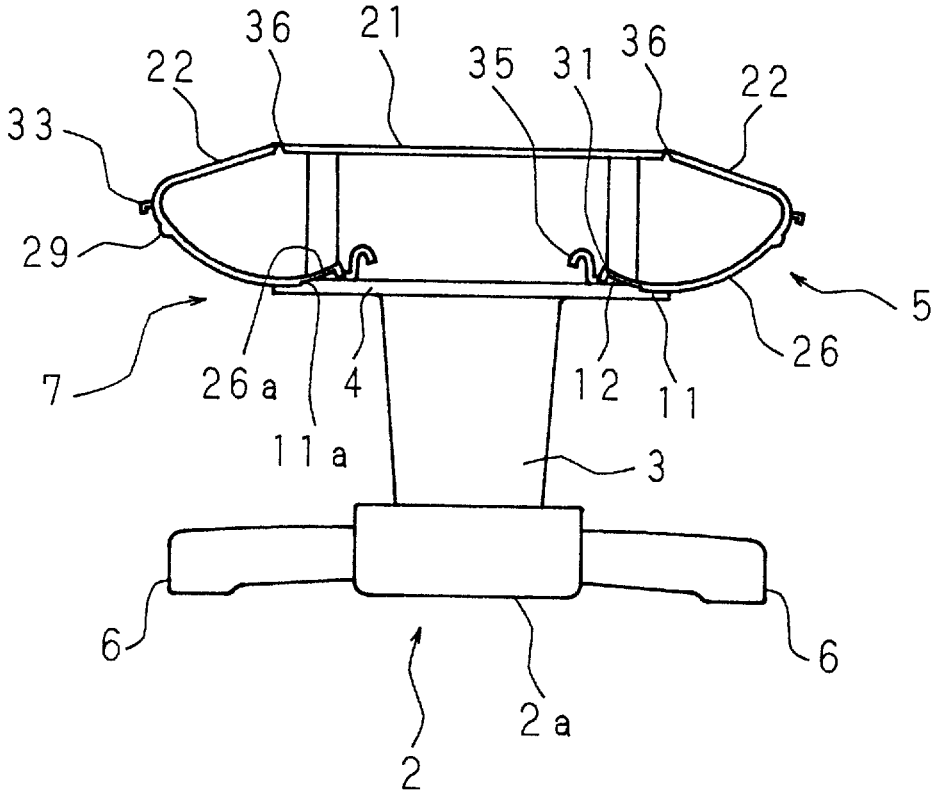
FIG. 10 is a side view of the ironing board shown in FIG. 9 as seen from the longitudinal direction.

FIG. 9 is a perspective view showing the condition in which the area of the large pressing surface 7*a* of the ironing board 1 shown in FIG. 2 is increased, while FIG. 10 is a side view of the ironing board shown in FIG. 9 as seen from the longitudinal direction. As shown in FIG. 10, locking pawls 31, 31 of the locking portions 27, 27 are latched to the taper fixing portions 12, 12 of the base plate 4, and rotation of the width adjusting portions 22 is in the locking condition to stand still in the opening direction. The branching pieces 26, 26 and step side surface of the fixing steps 26*a*, 26*a*, 27*a*, 27*a*, 27*a* of the locking portions 27, 27 are in contact with the step side surface 11*a* of the fixing step 11 of the base plate 4, and rotation of the width adjusting portions 22, 22 is in the locking condition to stand still in the closing direction.

In increasing the width of the large pressing surface 7*a* of the ironing board 1 configured as described above, applying fingers to the pull-out apertures 30, 30, the force is given to the width adjusting portions 22, 22 in the direction to pull it out from the large pressing portion 7, that is, in the opening direction. With this operation, locking holes 32, 32 are disengaged from latching pieces 35, 35 and the width adjusting portions 22, 22 rotate. And locking pawls 31, 31 come in contact with taper fixing portions 12, 12 and pull-out of the width adjusting portions 22, 22 is stopped. In this event, by the contact between the step side surface of the fixing steps 26*a*, 26*a*, 27*a*, 27*a*, 27*a* and the step side surface 11*a* of the base plate 4, rotation of the width adjusting portions 22, 22 is locked to prevent from returning. By the pull-out of the width adjusting portions 22, 22 as described above, the large pressing surface 7*a* has the width increased by part of the width adjusting portions 22, 22 added to the shell plate portion 21 and increases the area (see FIG. 10).

In reducing the width of the large pressing surface 7*a*, the force in the direction to insert the width adjusting portions 22 into the large pressing portion 7, that is, in the closing direction is given to the width adjusting portions 22, 22. With this operation, the step side surface of the fixing steps 26*a*, 26*a*, 27*a*, 27*a*, 27*a* disengage from the step side surface 11*a* of the base plate 4, and the width adjusting portions 22, 22 rotate. And locking holes 32, 32 fit into latching pieces 35, 35 to stop insertion of the width adjusting portions 22, 22 and rotation of the width adjusting portions 22, 22 is locked to prevent from returning. The insertion of the width adjusting portions 22, 22 in this way makes the large pressing surface 7*a* into the shell plate portion 21 only, thereby reducing the width of the large pressing surface 7*a* and decreasing the area of the large pressing surface 7*a* (see FIG. 3).

Figure 11:
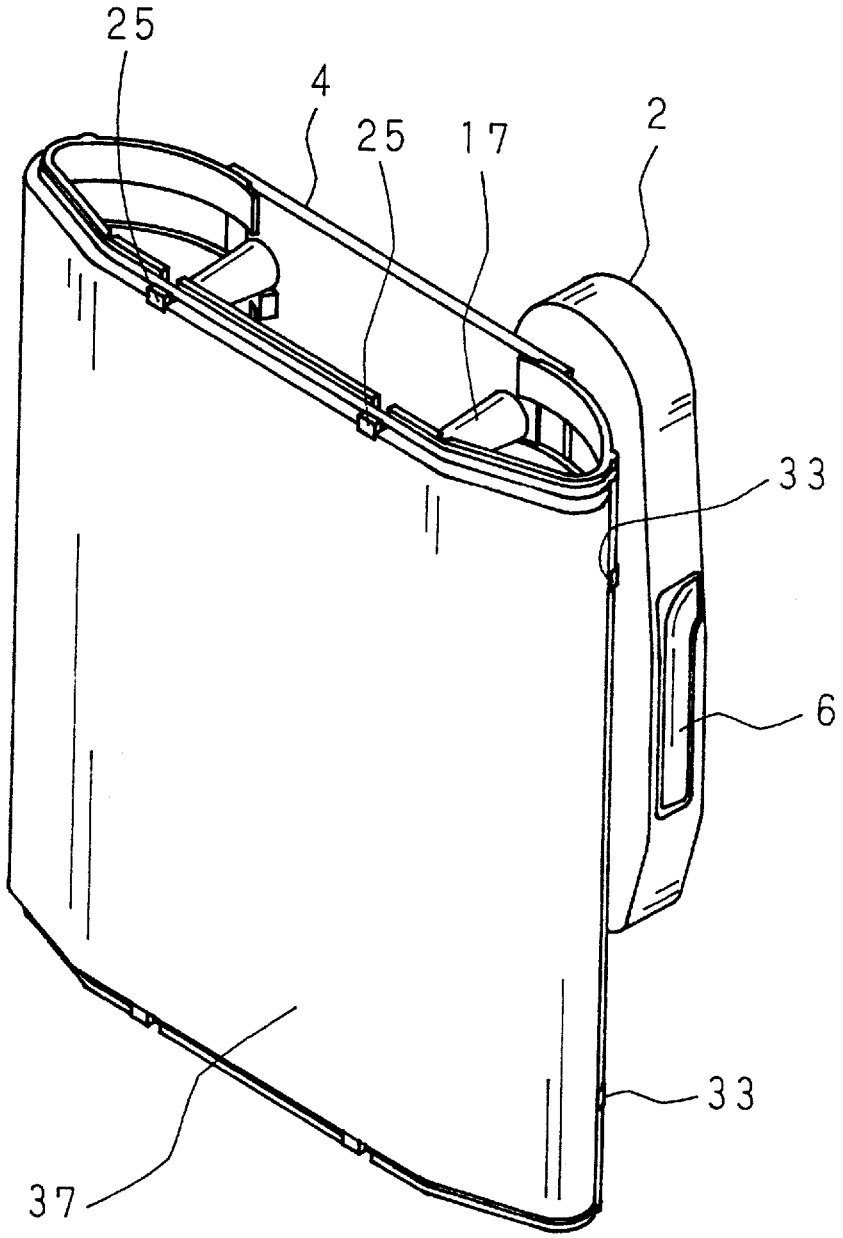
FIG. 11 is a perspective view showing the construction with a sheet fitted to the large pressing surface of the ironing board of the first embodiment.

FIG. 11 is a perspective view showing the construction of the condition when a sheet covers the large pressing surface 7*a* of the ironing board according to the first embodiment. Numeral 37 in the drawing is a sheet with cushioning capability. The sheet 37 is sewn in such a way that the surface and reverse sides of the rectangular flat plate form inner core with elasticity are covered with covering cloths. The covering cloths are butted around the inner core and on the circumferential side, engaging holes for engaging with cut riser pawls 25, 25, 33, 33 are formed. The sheet 37 is formed in the size nearly same as that when the large pressing surface 7*a* is increased, and the inner core is made of, for example, polyurethane and the covering cloths are cotton twill and nonwoven fabric on the surface side and on the rear side, respectively. The engaging holes are formed in the number and in the positions corresponding to that of the cut riser pawls 25, 25, 33, 33 of the lid plate 5. By engaging the engaging holes with corresponding to the cut riser pawls 25, 25, 33, 33, the large pressing surface 7*a* is covered with the sheet 37. In removing the sheet, the sheet is extended to pull out the engaging holes from the cut riser pawls 25, 25, 33, 33. In this way, the sheet 37 is removably fitted.

The center part of the sheet 37 is thicker than that at the circumferential part with engaging holes formed because of the thickness of the inner core and the surface of the sheet 37 is flush with the most protruding surface of the cut riser pawls 25, 25, 33, 33. With this configuration, even when cut riser pawls 25, 25, 33, 33 are formed, no interference is generated in the ironing work on the sheet 36, and even when the large pressing surface 7*a* is set to the bottom side, the small pressing portion 2 is able to be stably supported. When the large pressing surface 7*a* is set to the bottom side with the width of the large pressing surface 7*a* increased, it is possible to support the small pressing portion 2 more stably than with the width of the large pressing surface 7*a* reduced (see FIG. 1).

As described above, in the ironing board 1 according to the first embodiment a small pressing portion 2 is used when a small ironed substance is iron-pressed, and the large pressing portion 7 is used by inverting the ironing board 1 when a large ironed substance is iron-pressed. When a still larger ironed substance is iron-pressed, the width adjusting portions 22, 22 of the lid plate 5 are pulled out to expand the width of the large pressing surface 7*a*. Because in this way, with one piece of ironing board, pressing surfaces with varying areas can be used, troublesomeness of diverting the pressing surface can be eliminated and ironing efficiency can be improved. With the large pressing surface 7*a* reduced, no large space is required for storing the ironing board. In addition, because cur riser pawls 25, 33 are provided for removably mounting the sheet 37, the expendable sheet 37 can be replaced.

Under the first embodiment described above, the shafts 6*a* 6*b* protruding from the auxiliary leg 6 is fitted and pivoted into the fixing holes 14, 15 provided in the storing chamber 2*b*, but the invention shall not be limited only to this. For example, screw holes are provided in the supporting leg and screw passing holes are provided in the storing chamber, thereby allowing the auxiliary legs to be pivoted by the storing chambers by the use of screws, respectively. In this event, if the axial direction of the screw passing hole is formed at the gradient same as that of the fixing holes 14, 15 described above, the leg bottom of the auxiliary legs 6 become flush with the small pressing surface 2*a* and the whole auxiliary legs 6 can be stored in the storing chamber 2*b* at the time of storage.

Now referring to the drawings showing the second embodiment according to this invention, the second embodiment will be described in detail. The second embodiment is an ironing board including one pressing portion, and to this pressing portion, an auxiliary pressing portion with convex surface is attached.

Figure 12:
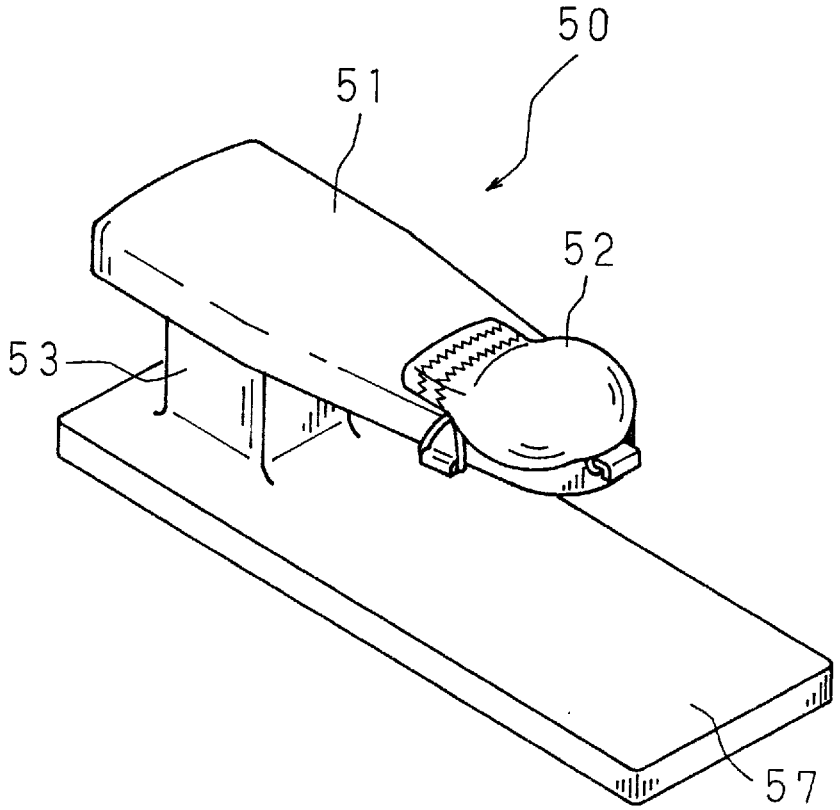
FIG. 12 is a perspective view showing the construction of the ironing board of the second embodiment.

FIG. 12 is a perspective view showing the configuration of the ironing board 50 according to the second embodiment. As shown in the drawing, the ironing board 50 is constructed by having a square pole shape pole 53 mounted erect in a height suited for ironing work little closer to one longitudinal side of the base board 57 in the form of rectangular flat plate, and by supporting the pressing portion 51 on the top surface of the pole 53. The pressing portion 51 is of a form of plasterer trowel as seen on the plane, that is, of a flat plate form in which one longitudinal side is angular and the other side is round and narrow in width, and on a base made of synthetic resin such as ABS resin, polyurethane sheet with cushioning capability is placed, and the surface is covered with cotton twill fabric. The bottom surface of the angular side of the pressing portion 51 is supported with the pole 53 and the tip end side is located on the upper part of the base board 57. On the top surface on the tip end side of the pressing portion 51, an auxiliary pressing portion 52 with a convex portion is mounted with the convex portion above.

Figure 13:
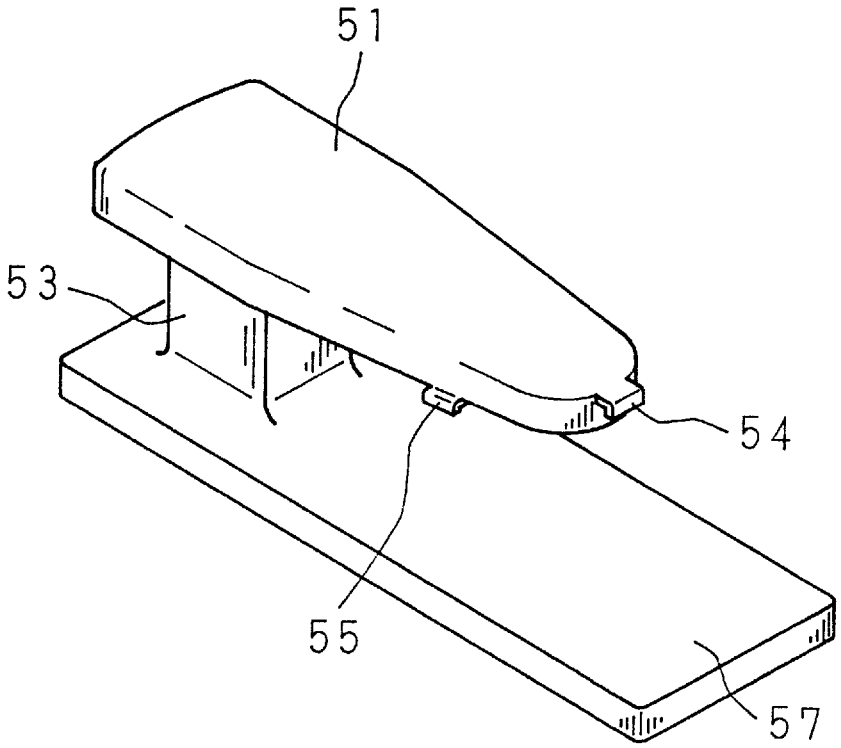
FIG. 13 is a perspective showing the condition with the auxiliary pressing portion of the ironing board of the second embodiment removed.

FIG. 13 is a perspective view showing the condition of the ironing board with the auxiliary pressing portion 51 removed. At the tip end of the pressing portion 51, a tip-end hook 54 protruding forwards from the front top portion is formed. On both lateral end surfaces of the pressing portion 51, rear hooks 55, 55 protruding from the end face bottom portion little closer to the tip end from the longitudinal center to the side are formed. The tip-end hook 54 and the rear hooks 55, 55 have a L-letter form cross section, respectively, and direct the tip end downwards.

Figure 14:
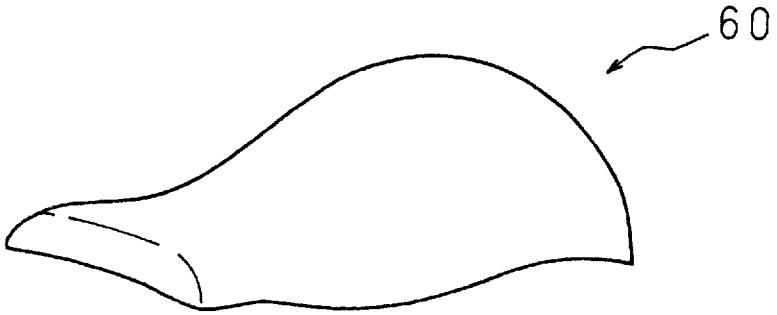
FIG. 14 is an enlarged perspective view showing the core bed of the auxiliary pressing portion of the second embodiment.
Figure 15:
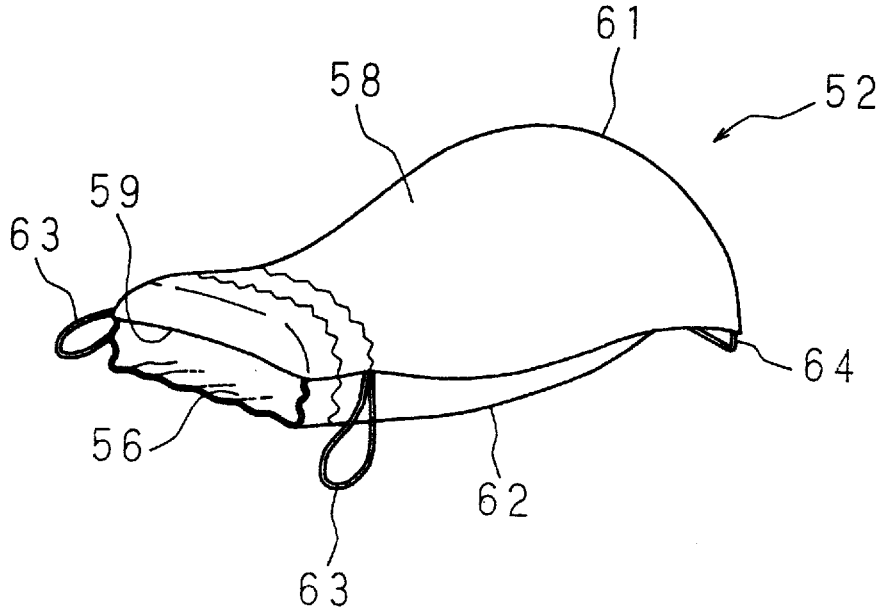
FIG. 15 is an enlarged perspective view showing the construction of the auxiliary pressing portion of the second embodiment.
Figure 16:
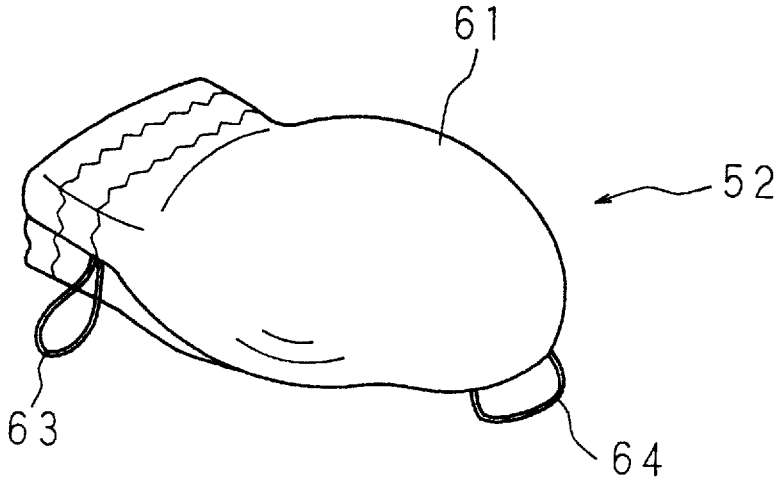
FIG. 16 is an another enlarged perspective view showing the construction of the auxiliary pressing portion of the second embodiment.

FIG. 14 is an enlarged perspective view showing the core material of the auxiliary press portion 52. As shown in FIG. 14, the core material 60 of the auxiliary press portion 52 has the tip end nearly hemispherical in the convex form, and is integrally formed in a flat plate shape with the rear side thinner than the top end. FIG. 15 and FIG. 16 are enlarged perspective views showing the configuration of the auxiliary pressing portion 52. As shown in FIG. 15 and FIG. 16, the auxiliary pressing portion 52 is equipped with a convex portion 61 on the face portion and cloth-made reverse cover 62 on the reverse portion, and is formed in a bag shape with the rear end apertured. For the procedure to form the auxiliary pressing portion 52, first of all, cloth-made core covers 58, 59 are covered over the top and the bottom surfaces of the core material 60 shown in FIG. 14 and the convex portion 61 is sewn. Then, a reverse cover 62 in the width size with the rear portion longer than the reverse surface of the core material 60 is prepared, and this top surface and the bottom surface of the convex portion 61 are butted, and the circumference is sewn excluding the rear end portions, respectively. In this way, the auxiliary pressing portion 52 is formed in a bag shape with an insertion hole 56 with an allowance for inserting a hand at the rear end portion. A hand is inserted between the convex portion 61 and the reverse cover 62 from the insertion hole 56. The core material is formed with synthetic resin such as polyurethane, PP, PE (polyethersulphne), polyamide, etc.

As shown in FIG. 15 and FIG. 16, to the tip end of the auxiliary pressing portion 52, a tip-end loop 64 is sewn on and the tip-end loop 64 has a size able to be engaged with the tip-end hook 54 shown in FIG. 13. To both end surfaces in the lateral direction little closer to the rear portion of the auxiliary pressing portion 52, rear loops 63, 63 are sewn on, and the rear loops 63, 63 have sizes able to be engaged at the position corresponding to the rear hook 55, 55. The tip-end loop 64 and rear loops 63, 63 are formed, for example, with rubber resin, elastomer, etc. with stretchability, and even in the case of the material with no stretchability, it is no problem if it has a loop length enough to be removed from the hook.

When the ironing board 50 configured as described above is used, the tip-end loop 64 and rear loops 63, 63 are engaged with the tip-end hook 54 and rear hooks 55, 55 of the pressing portion 51, respectively, and the auxiliary pressing portion 52 is mounted to the pressing surface 51 to use the convex pressing surface of the auxiliary pressing portion 52. If the convex pressing surface is not required, the tip-end loop 64 and the rear loops 63, 63 are removed from the tip-end hook 54 and rear hooks 55, 55, respectively, and the plane form pressing portion 51 can be used throughout the whole area.

Figure 17:
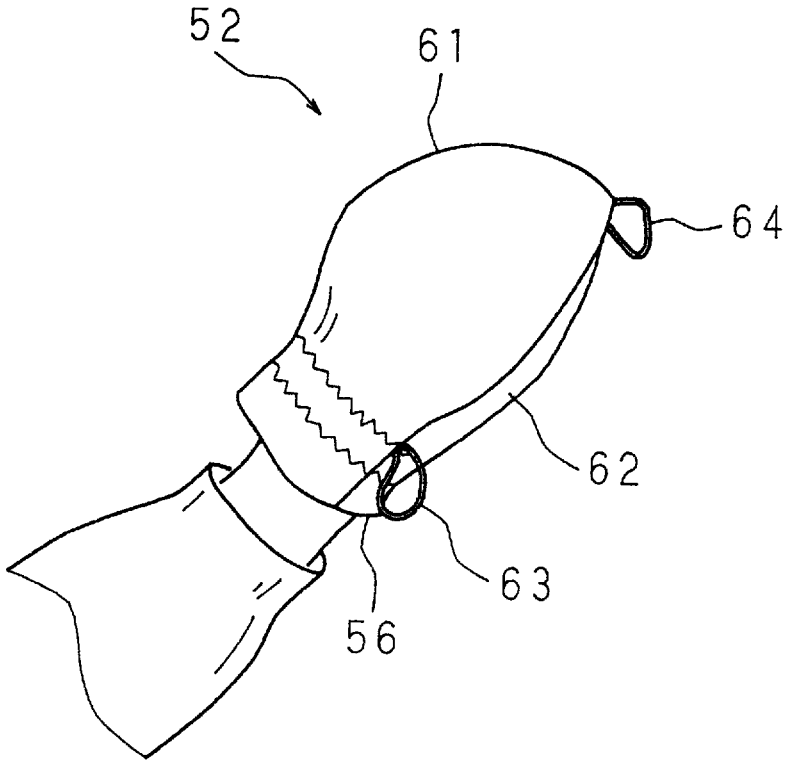
FIG. 17 is a perspective view showing the condition in which the auxiliary pressing portion of the second embodiment is fitted to a hand.

FIG. 17 is a perspective view showing the condition in which the auxiliary pressing portion 52 is equipped to a hand. When the ironed substance should be iron-pressed partly, it is possible to conveniently and easily iron-press by equipping the auxiliary pressing portion 52 to the hand and bringing the convex portion 61 into contact with the pressed portion of the ironed substance.

As described above, because the auxiliary pressing portion 52 having a convex-shape pressing surface can be easily equipped to or removed from the pressing portion 51, it is possible to use the pressing surface suited for the shape of the ironed substance without special labor to replace the pressing surface.

Now referring to drawings showing the third embodiment of this invention, the third embodiment will be described. The third embodiment is an ironing board including one pressing portion, to which a retainer member for restraining the ironed substance is equipped.

Figure 18:
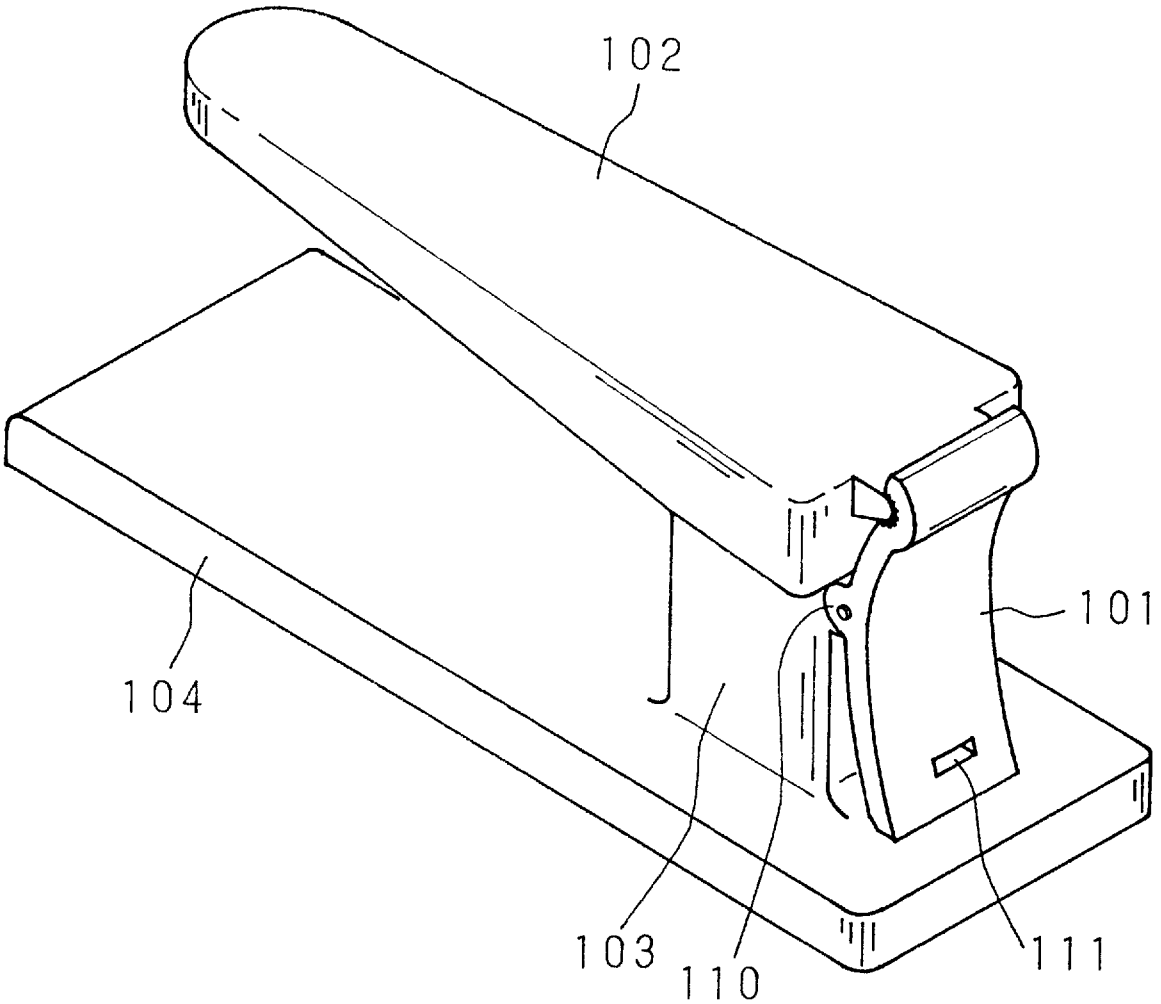
FIG. 18 is a perspective view showing the construction of the ironing board of the third embodiment of this invention.
Figure 19:
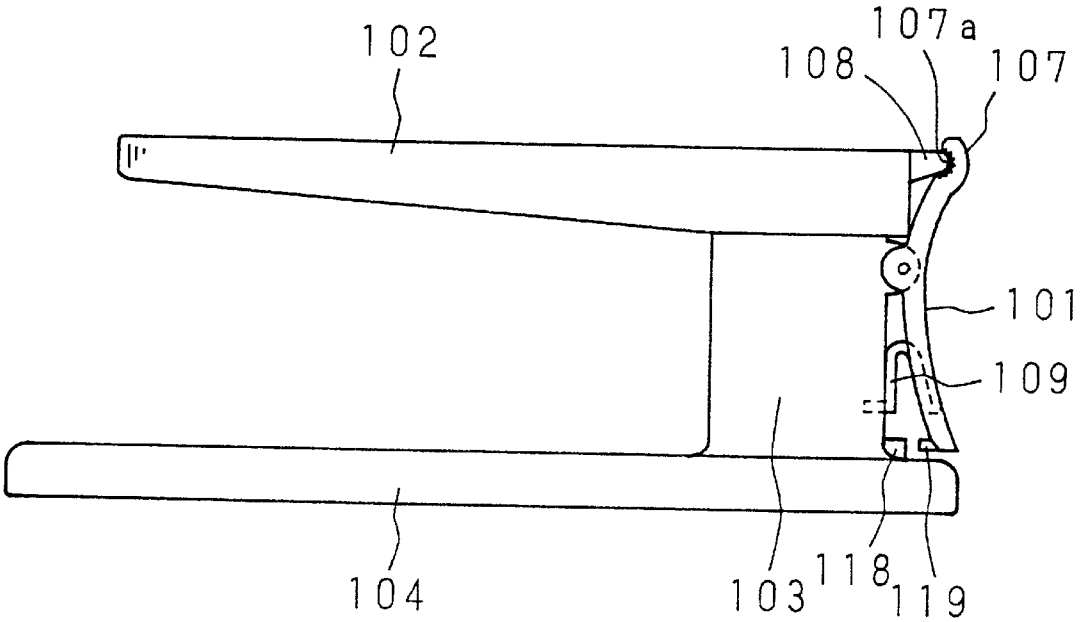
FIG. 19 is an elevation of FIG. 18.

FIG. 18 is a perspective view showing the construction of the ironing board according to the third embodiment, and FIG. 19 is an elevation of the third embodiment. As shown in the drawings, the ironing board is configured by mounting erect a square pole of a height suited for ironing work little closer to one longitudinal side on the base board 104 in the form of flat rectangular parallelepiped and supporting a pressing portion 102 at the top of the pole 103. The pressing portion 102 is of a form of plasterer trowel as seen on the plane, that is, of a flat plate form in which one longitudinal side is angular and the other side is round and narrow in width, and on the end-surface top portion on the angular side, a pressure supporting portion 108 protruding in the longitudinal direction is equipped with a predetermined lateral size. The round side of the pressing portion 102 is located above the base board 104, and the pressing portion 102 is supported with the pole 103 at the bottom surface on the angular side. On the top surface of the pressing portion 102, a sheet with cushioning capability, for example, a sheet covering a urethane lump with cotton twill fabric is equipped.

Figure 20:
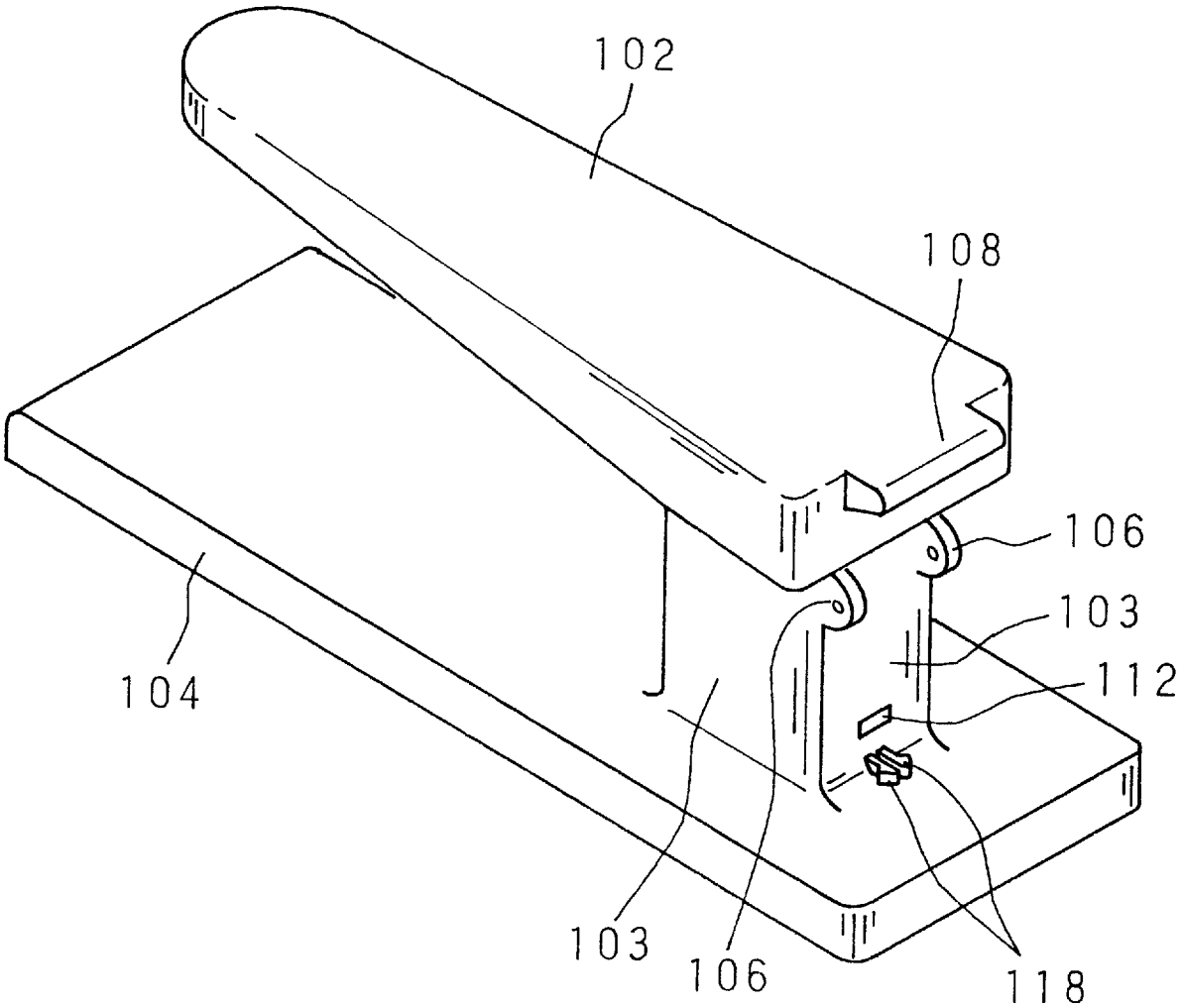
FIG. 20 is a perspective view showing the construction before a retainer plate of the ironing board of the third embodiment is installed.

FIG. 20 is a perspective view showing the construction of the ironing board excluding the retainer plate. The pole 103 is made of synthetic resin such as ABS resin, and as shown in the drawing, brackets 106, 106 having holes of a predetermined diameter on the top portion of both lateral ends of the surface on the side same as the retainer support 108 are equipped in a pair at the same height. To the pole 103, lock support portions 118, 118 aligning in the lateral direction on the center of the base end portion of the surface with the brackets 106, 106 equipped are protrudably mounted, and their tip end portions have latching pawls directed outside. The lock support portions 118, 118 constitute the locking mechanism later discussed. To the pole 103, a spring seat hole 112 is elongately formed in the lateral direction for equipping a plate spring 109 between the bracket 106 and the lock support portion 118.

Figure 21:
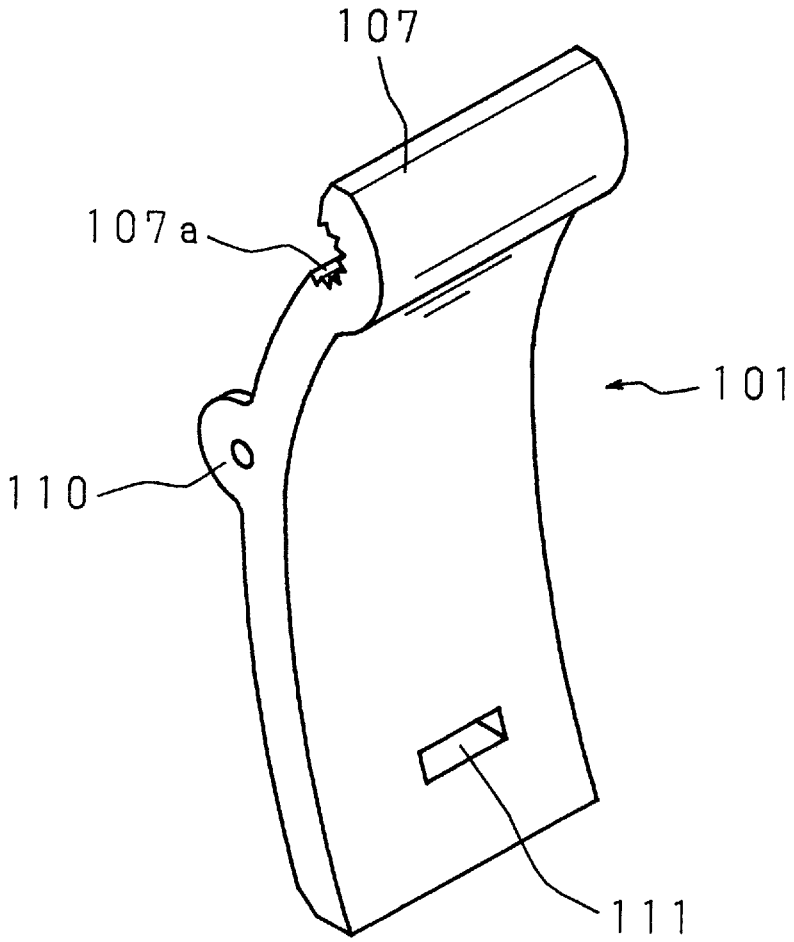
FIG. 21 is a perspective view showing the construction of the retainer plate of the third embodiment.
Figure 22:
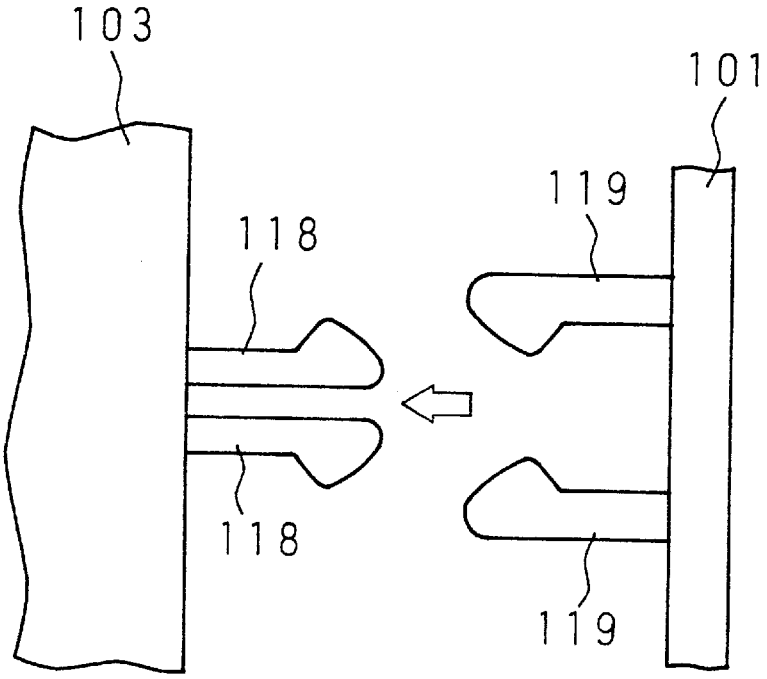
FIG. 22 is a plan view showing the construction of the locking mechanism of the third embodiment.

FIG. 21 is an enlarged perspective view showing the construction of the retainer plate 101. FIG. 22 is an enlarged plan view showing the construction of the locking mechanism, and shows the lock support portion 118 of the pole 103 and the lock inserting portion 119 of the retainer plate 101. The retainer plate 101 is an integrally molded product of synthetic resin such as ABS resin, and is equipped with the surface of the pole 103 with the bracket 110 formed.

As shown in FIG. 21, the retainer plate 101 is a rectangular member as seen on the plane with one side surface made in the convex form and the vertical side bent, and on the upper part, there formed is a retainer portion 107 having a retainer surface 107*a* on the convex side surface. The retainer portion 107 is slightly bent in the direction reversal to the convex form of the retainer plate 101, and to the concave retainer surface 107*a,* grooves are formed in a plurality up to both edges in the lateral direction orthogonally intersecting in the vertical direction to make the cross-section in a sawtooth form. The lateral size of the retainer portion 107 is of the size nearly same as that of the retainer support portion 108 of the pressing portion 102, and the ironed substance is held and squeezed between the retainer portion 107 and the retainer support portion 108. To both lateral ends of the convex side surface of the retainer plate 101, brackets 110, 110 are formed at the same height little closer to the upper side from the under of vertical direction, and has a hole of nearly same size as that of the bracket 106 of the pole 103. The length between brackets 110, 110 is formed longer than the length between brackets 106, 106.

To the lower part of the retainer plate 101, the spring seat hole 111 is provided at the lateral center. The spring seat hole 111 is long in the lateral direction and is nearly same size as the spring seat hole 112 of the pole 103, and is formed at the position opposite to the spring seat hole 112 when the retainer plate 101 is equipped with the pole 103. To the lowermost portion of the convex side surface of the retainer plate 101, lock insertion portions 119, 119 arranged in the lateral direction are protrudably formed, and to each of the tip end portions, latching pawls whose tip end portion is directed inwards are equipped. The lock insertion portions 119, 119 constitute a lock mechanism together with the above-mentioned lock support portions 118, 118 described above. As shown in FIG. 22, the intervals of the lock insertion portions 119, 119 protrudably formed in the lateral direction is formed wider than the intervals of lock support portions 118, 118, and the lock insertion portion 119 and the lock support portion 118 are formed in the positions opposite to relevant latching pawls when the retainer plate 101 is equipped with the pole 103. The vertical size of the retainer plate 101 is designed not to exceed the height from the top surface of the base board 104 to the top surface of the pressing portion 102.

Figure 23:
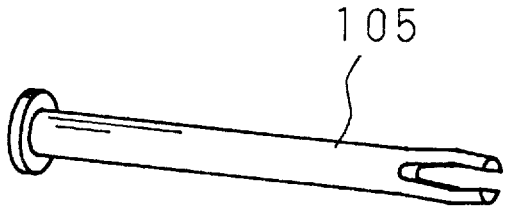
FIG. 23 is a perspective view showing the axis serving as a rotating center of the retainer plate of the third embodiment.
Figure 24:
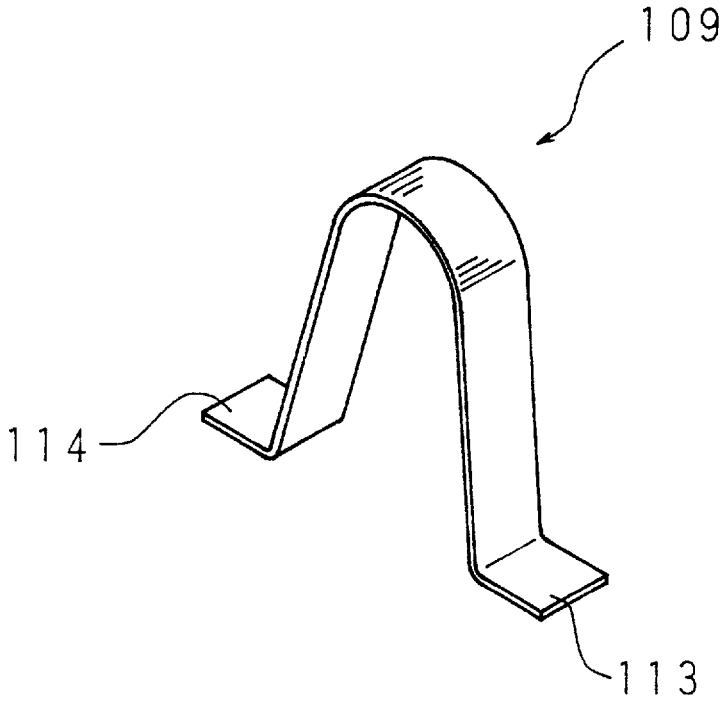
FIG. 24 is a perspective view showing the construction of the plate spring of the third embodiment.

FIG. 23 is an enlarged perspective view showing the shaft 105 serving the rotation center of the retainer plate 101, while FIG. 24 is an enlarged perspective view showing the construction of the plate spring 109 which gives pressing force to the retainer plate 101. When the retainer plate 101 is equipped, as shown in FIG. 18 and FIG. 19, the retainer surface 107*a* of the retainer plate 101 shall be faced to the retainer support portion 108 of the pressing portion 102, and brackets 110, 110 of the retainer plate 101 are arranged outside of the brackets 106, 106 of the pole 103 and the shaft 105 is passed through the corresponding holes. The shaft 105 has a size longer than the distance between brackets 110, 110, and as shown in FIG. 23, one end of the shaft 105 has a head in the diameter greater than the holes of the brackets 106, 110, and the other end is split. The shaft 105 is allowed to pass through, and the tip split portion is folded to stake the shaft 105. With this operation, the retainer plate 101 is allowed to rotate around the shaft 105.

Then, the plate spring 109 is equipped. As shown in FIG. 24, the plate spring 109 has a U-letter cross section, and has a shape with both tip ends 113, 114 bent outwards. As shown in FIG. 19, with the convex portion of the plate spring 109 above, the tip end portion 113 and the tip end portion 114 are inserted into the spring seat hole 111 of the retainer plate 101 and the spring seat hole 112 of the pole 103, respectively. By the elastic force of the plate spring 109, to the retainer plate 101, the force in the direction drifting away from the pole 103 at the lower portion from the bracket 110 is exerted, while at the upper portion, the force in the direction in the pressing the retainer receiving portion 108 is exerted. When the ironed substance is held between, a force going toward the side of the pole 103 is applied to the lower part of the retainer plate 101 to drift away the retainer portion 107 from the retainer support portion 108, and after one end of the ironed substance is placed on the retainer support portion 108, the force going toward the pole 103 side is removed. With this operation, the retainer portion 107 presses the ironed substance against the retainer support portion 108.

It is possible to maintain the retaining condition even when the hand is removed from the retainer plate 101 by inserting a lock insertion portion 119 into the lock supporting portion 118 when the force going toward the pole 103 side is applied to the lower portion of the retainer plate 101. As shown in FIG. 22, as the lock insertion portion 119 is moved in the direction shown by the outline arrow mark, the latching pawl of the lock insertion portion 119 collides against the latching pawl of the lock support portion 118. Further moving the retainer plate 101 with the latching pawl being slid expands the clearance between lock insertion portions 119, 119 with the material elasticity of the lock receiving portion 118 and the lock insertion portion 119 and the latching pawl of the lock insertion portion 119 goes over the latching pawl of the lock support portion 118, and is inserted in the base end portion. This condition is the locking state. Then, applying the reverse force, that is, the force drifting away from the pole 103 is applied to the lower part of the retainer plate 101 expands the clearance between the lock insertion portions 119, 119 and the lock insertion portion 119 is removed from the lock support portion 118 and locking is released. The size and the shape of these latching pawls are designed in such a manner that locking is not released only with the returning force of the plate spring 109 under the locking condition and at the same time locking can be released with a suitable force.

Figure 25:
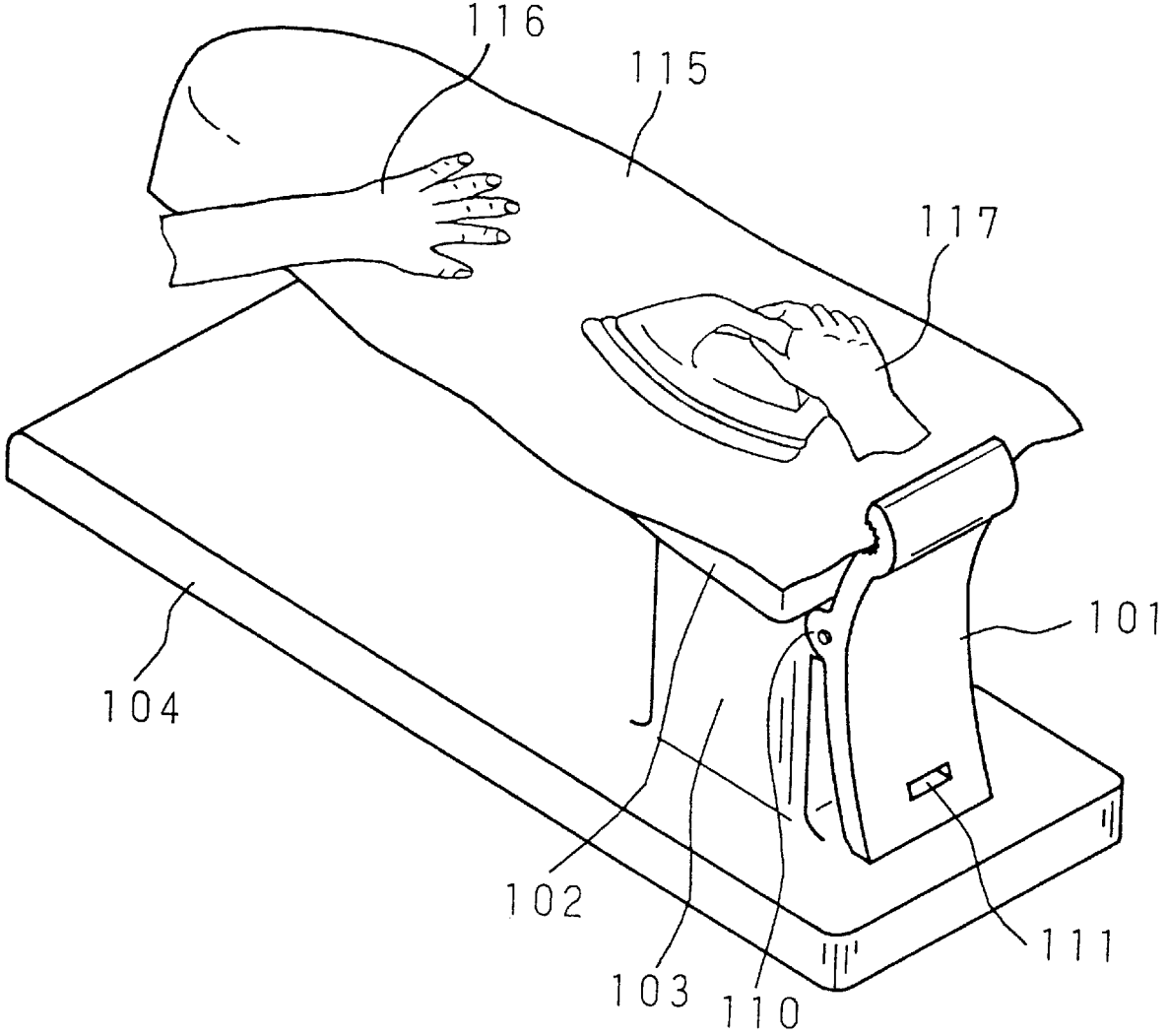
FIG. 25 is a perspective view showing the state in which the ironed substance is iron-pressed using the ironing board of the third embodiment.

FIG. 25 is a perspective view showing the state in which the ironed substance 115 is iron-pressed using the ironing board according to the third embodiment. The lower portion of the retainer plate 101 is pressed to the pole 103 side for locking state and one side of the ironed substance 115 is placed on the retainer support portion 108. Pulling the lower part of the retainer plate 101 in the direction to draft away from the pole 103, the ironed substance 115 is held by the retainer portion 107 and the retainer support portion 108. With one hand 116 having no iron, the other side of the ironed substance is pressed, and the hand 117 having an iron is moved to carry out iron-pressing.

As described above, since the ironing board according to the third embodiment has one side of the ironed substance pressed with the retainer plate 101 and the other side pressed with one hand, the ironed substance 115 is not moved as the iron moves, providing the ironed substance 115 with accurate creases. Because the retainer surface 107*a* of the retainer plate 101 is of the concave shape and serrated on the cross section, the ironed substance 115 can be strongly held between the retainer plate and the retainer support surface 108 and the ironed substance 115 is pulled during ironing and does not slip out from the retainer plate 101. In addition, sufficient pressing force is able to be applied to the retainer portion 107 by the use of the plate spring 109 and the thick ironed substance 115 can be satisfactorily restrained. Furthermore, because the locking mechanism hold the drifting-away state of the retainer portion 107 and the retainer support portion 108, the ironed substance 115 can be placed on the retainer support portion 108 using both hands and wrinkles will not be generated in the holding portion.

Now referring to the drawings showing the fourth embodiment, the fourth embodiment is described. The fourth embodiment is an ironing board including another retainer member of a separate construction.

Figure 26:
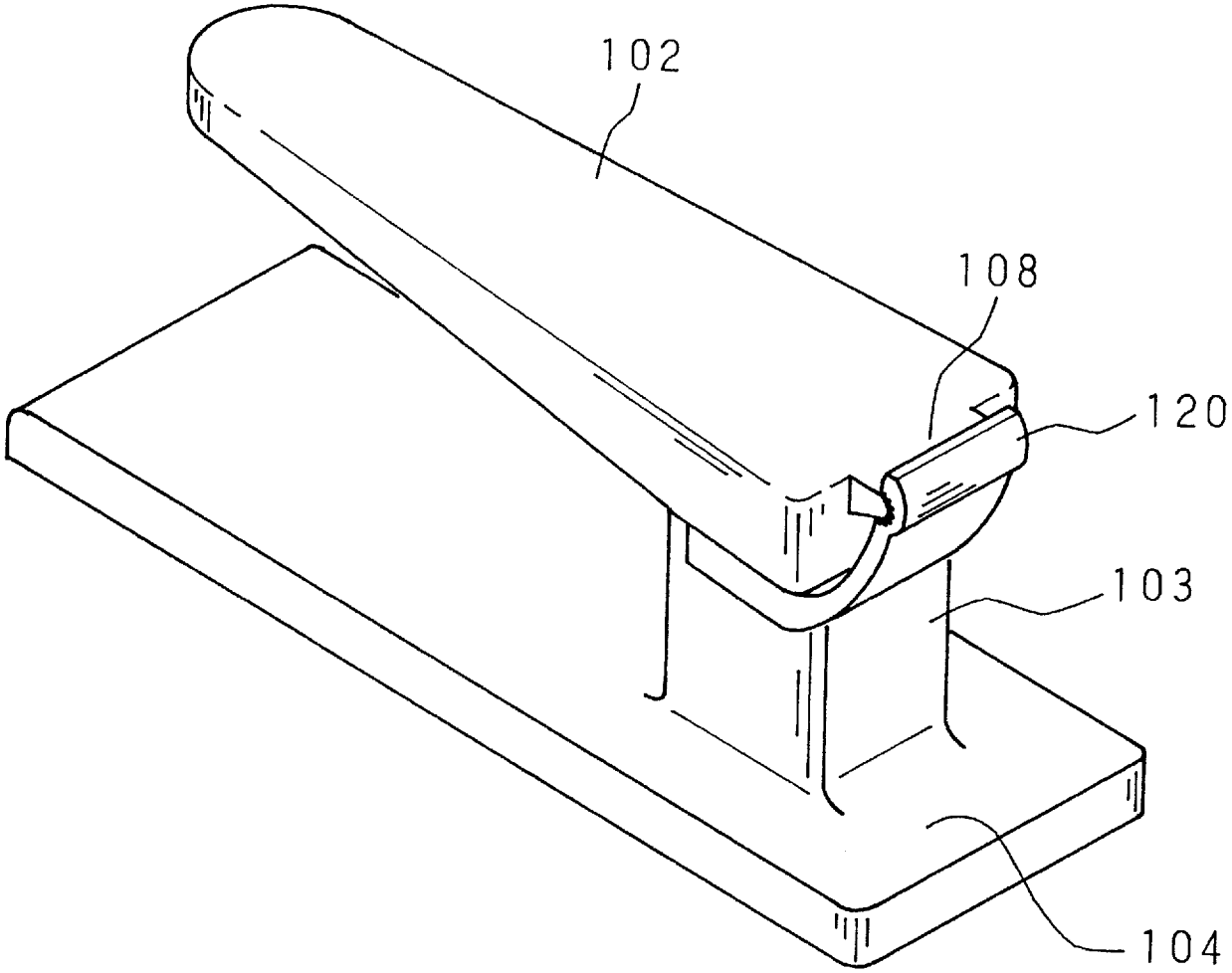
FIG. 26 is a perspective view showing the construction of the ironing board of the fourth embodiment.
Figure 27:
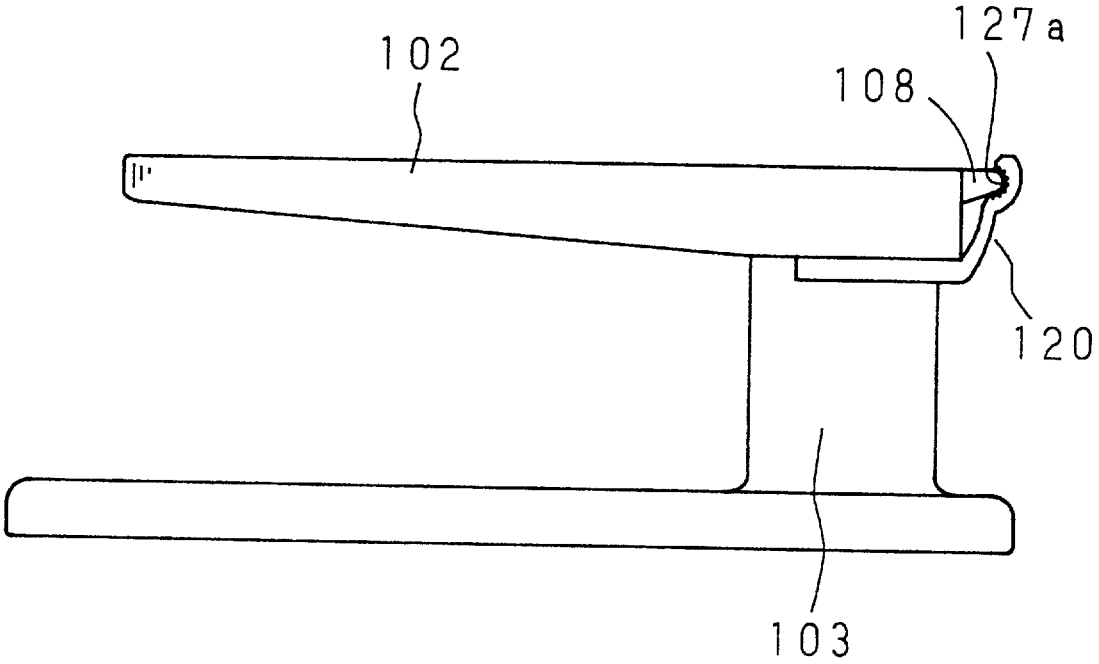
FIG. 27 is an elevation of FIG. 26.

FIG. 26 is a perspective view showing the construction of the ironing board according to the fourth embodiment, and FIG. 27 is an elevation of the ironing board. As shown in the drawing, to the pole 103 of the ironing board, a retainer plate 120 is equipped in such a manner to bring the retainer surface 127*a* in contact with the retainer support portion 108 of the pressing portion 102. To the pole 103, holes (not illustrated) for equipping the retainer plate 120 are formed at the same height, respectively, on the surface on the same side of the retainer support portion 108 and the top portion of both side surfaces linked to the surface.

Figure 28:
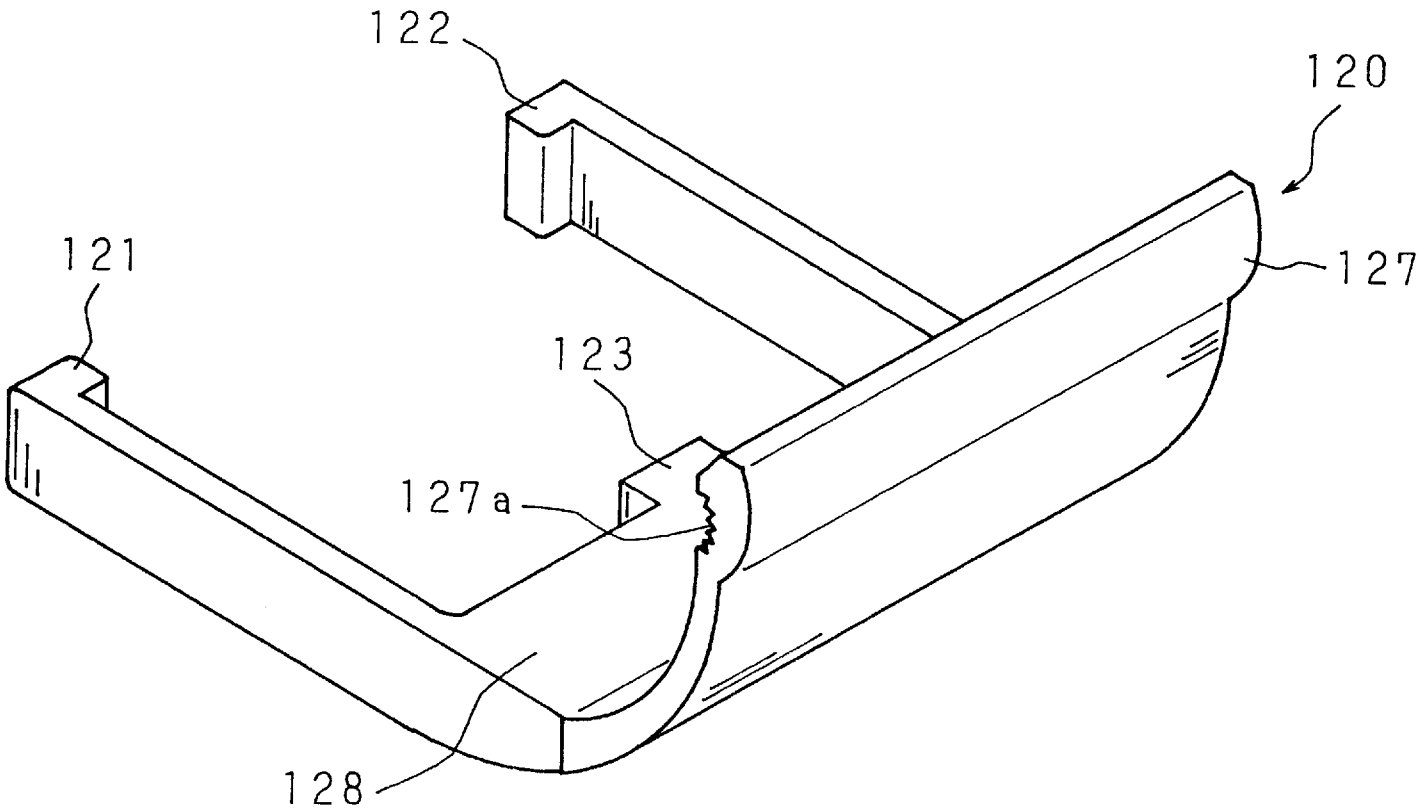
FIG. 28 is a perspective view showing the construction of the retainer plate of the fourth embodiment.

FIG. 28 is an enlarged perspective view showing the construction of the retainer plate according to the fourth embodiment. The retainer plate 120 is integrally molded with synthetic resin such as ABS resin. The retainer plate 120 has a predetermined width, and comprises a retainer portion 127 which bends in such a manner to form one side surface in a convex and curve the side of vertical direction, and a fitting portion 128 which extends nearly horizontally in the same width from the bottom portion of the retainer portion 127. The fitting portion 128 has the fitting legs 121, 122, 123 further extended from both lateral ends and the center, and has the fitting legs 121, 122 longer than the fitting leg 123, and their tip ends bent towards the inside. The relevant lengths and the tip end shapes of these fitting legs 121, 122, 123 are formed in the size which fit in the position corresponding to the relevant holes of the pole 103.

At the upper part on the concave surface side of the retainer portion 127, a retainer surface 127*a* is formed. The retainer surface 127*a* is still slightly curved in the direction same as the concave form of the retainer portion 127, and grooves shaved to both edges in the lateral direction are formed in a plurality in the vertical direction, serrating the cross sectional form. The width size of the retainer support portion 108 in contact with the retainer plate 120 and the retainer surface 127*a* is nearly same size as the width size of the pole 103, and is designed to hold and press the ironed substance between the retainer portion 127 and the retainer support portion 108. The construction excluding the retainer plate 120 and the pole 103 is the same as that of the ironing board shown in FIG. 18, and the explanation will be omitted with same numbers assigned to the corresponding portions.

When the retainer plate 120 is fitted, as shown in FIG. 26 and FIG. 27, the retainer surface 127*a* of the retainer plate 120 is brought in contact with the retainer receiving portion 108 of the pressing portion 102, and the fitting legs 121, 122, 123 of the retainer plate 120 are allowed to fit into the holes of the pole 103, respectively. Because the retainer plate 120 is curved as described above, the retainer surface 127*a* presses the retainer support portion 108 with the material elasticity, and when the force in the direction to drift away from the pole 103 is exerted, the retainer surface 127*a* drifts away from the retainer support portion 108, and when this force is removed, the retainer support portion 108 is pressed again with the returning force.

When the ironed substance is iron-pressed using the ironing board according to the fourth embodiment with the construction described above, the retainer surface 127*a* of the retainer plate 120 is allowed to drift away from the retainer support portion 108 by hand, and one side of the ironed substance is placed on the retainer support portion 108, and the hand is removed from the retainer plate 120. With this operation, the ironed substance is held by the retainer surface 127*a* and the retainer support portion 108, preventing the ironed substance from being displaced as the iron moves and accurately providing creases, etc.

The embodiments described above area only examples of this invention and it is to be understood that the invention is not intended to be limited to the specific embodiments but should be only equipped with the retainer member for pressing the ironed substance against the pressing portion.

As described above, in this invention, since the pressing surfaces are provided on the opposite sides of a pole for supporting the first and the second pressing portions, only by inverting the ironing board, the pressing surfaces with varying areas can be used in accord with the size of the ironed substance. In addition, because the width of the pressing surface can be expanded and reduced, the pressing surface with varying areas can be diverted with a simple operation. In addition, since the face portion has the convex-shape auxiliary pressing portion removably equipped, with only one piece of ironing board, the concave or plane pressing surface can be diverted in accord with the shape of the ironed substance. In this way, without taking time and trouble in replacing the pressing surfaces in this way, iron-pressing of various ironed substances can be easily and dexterously carried out, and the ironing efficiency is improved and the consumption power is reduced as a result of reduction in ironing time.

Because one side of the ironed substance is pressed and restrained with the retainer member equipped to the ironing board, and the other side can be pressed with one hand, the ironed substance is not displaced during pressing and new wrinkles are not generated, and desired creases can be easily and quickly provided. As a result, the present invention takes excellent effects including improved ironing efficiency, reduced power consumption associated with the improved ironing efficiency, etc.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An ironing board, comprising;

a first pressing portion and a second pressing portion having pressing surfaces to be brought in contact with an ironed substance;

a pole supporting the first and the second pressing portions at either end thereof;

the first pressing portion and the second pressing portion having their respective pressing surfaces on the side opposite to the pole;

the first pressing portion having a pressing surface of smaller area than that of the second pressing portion, and the first pressing portion including supporting legs extending laterally outward of said first pressing portion for supporting the ironing board when the second pressing portion is in use.

2. The ironing board according to claim 1, wherein at least one of the first and second pressing portions is constructed so that the corresponding pressing surface can be increased and reduced in area.

3. The ironing board according to claim 1, wherein the first pressing portion includes:

storing chambers concavely provided on opposite side surfaces for storing the supporting legs, respectively; and each supporting leg having an end thereof mounted in one of the storing chambers for pivotal movement from a first position in which the leg is housed within its storing chamber to a second position in which it protrudes out of the chamber.

4. An ironing board in accordance with claim 1, further comprising an auxiliary pressing portion detachably mounted on one of the pressing portions and having a generally hemispherical convex face portion.

5. The ironing board according to claim 4, wherein the pressing portion includes a hook, and the auxiliary pressing portion includes a latching portion adapted to be engaged with the hook.

6. The ironing board according to claim 5, wherein the auxiliary pressing portion has the convex face portion and a flat reverse portion and is formed in a bag shape with one side apertured.

7. The ironing board according to claim 4, wherein the auxiliary pressing portion has the convex face portion and a flat reverse portion and is formed in a bag shape with one side apertured.

8. An ironing board, comprising:

a first pressing portion and a second pressing portion having pressing surfaces to be brought in contact with an ironed substance, a pole supporting the first and the second pressing portions at either end thereof;

the first pressing portion and the second pressing portion having their respective pressing surfaces on the side opposite to the pole;

at least one of the first and second pressing portions being constructed to have the area of the pressing surface increased and reduced;

at least one of the first and the second pressing portions including:

a base plate equipped with a column and a first and second engaging members;

a pressing plate supported by the column and constituting the pressing surface; and width adjusting plates pivoted on both ends of the pressing plate respectively, formed concavely outwards, rotatable in the direction in which both the tip end portions open and close, and having a third and a fourth engaging members to be engaging respectively with the first and the second engaging members.

9. An ironing board, comprising:

a first pressing portion and a second pressing portion having pressing surfaces to be brought in contact with an ironed substance, a pole supporting the first and the second pressing portions at either end thereof;

the first pressing portion and the second pressing portion having their respective pressing surfaces on the side opposite to the pole;

the first pressing portion having a pressing surface of smaller area than that of the second pressing portion, and the first pressing portion including two supporting legs for supporting the second pressing portion;

first pressing portion further including:

storing chambers concavely provided on opposite side surfaces for storing the supporting legs, respectively; and shafts rotatably pivoting the base portion of the supporting legs in the storing chambers in the direction in which the supporting legs appear and disappear from the storing chamber;

wherein the engagement of the first and the third engaging members stops rotation in the direction in which the tip end portions of both the width adjusting plates close, and the engagement of the second and the fourth engaging members stops rotation in the direction in which the tip end portions of the both width adjusting plates open.

10. The ironing board according to claim 9, wherein at least one of the first and the second pressing portions includes:

a base plate equipped with a column and a first and a second engaging members;

a pressing plate supported by the column and constituting the pressing surface; and width adjusting plates pivoted on both ends of the pressing plate respectively, formed concavely outwards, rotatable in the direction in which both the tip end portions open and close, and having a third and a fourth engaging members to be engaged respectively with the first and the second engaging members, wherein the engagement of the first and the third engaging members stops rotation in the direction in which the tip end portions of both the width adjusting plates close, and the engagement of the second and the fourth engaging members stops rotation in the direction in which the tip end portions of the both width adjusting plates open.

11. The ironing board according to claim 10, further comprising:

an elastic cushioning portion being equipped with holes on its perimeter; and hooks provided on the perimeter of the pressing plate and the width adjusting plate, the cushioning portion holes receiving the hooks and being removably fitted to the surface of the pressing plate and the width adjusting plate utilizing the cushioning portion's elasticity.

12. An ironing board having a pressing portion with the pressing surface for contacting an ironed substance, the pressing surface being capable of being increased and reduced in area, the pressing portion comprising:

a base plate having a first engagement member;

a pressing plate supported in spaced relationship above the base plate and constituting the pressing surface;

a convex width adjusting plate substantially lengthwise coextensive with and pivotally mounted on either side of the pressing plate, each adjusting plate being rotatable between a retracted position in which it is substantially housed between said base and pressing plates and an extended position in which it forms a substantial convex lateral extension of the pressing plate, and having a second engaging member adapted to be engaged with the first engaging member, the engagement of the first and second engaging members stopping rotation of the width adjusting plates so as to retain them in one of their retracted and extended positions.

13. The ironing board according to claim 12, wherein the base plate has a third engaging member and the width adjusting plate has a fourth engaging member to be engaged with the third engaging member, and the engagement of the third and the fourth engaging members stopping rotation of the width adjusting plates so as to retain them in the other of their retracted and extended positions.

14. An ironing board in accordance with claim 12, further comprising an auxiliary pressing portion detachably mounted on the pressing portion and having a generally hemispherical convex face portion.

15. The ironing board according to claim 14, wherein the pressing portion includes a hook, and the auxiliary pressing portion includes a latching portion adapted to be engaged with the hook.

16. The ironing board according to claim 15, wherein the auxiliary pressing portion has the convex face portion and a flat reverse portion and is formed in a bag shape with one side apertured.

17. The ironing board according to claim 14, wherein the auxiliary pressing portion has the convex face portion and a flat reverse portion and is formed in a bag shape with one side apertured.

18. An ironing board comprising:

a pressing portion having a pressing surface for contacting the ironed substance;

a retainer member for restraining part of the ironed substance against the pressing portion;

a pole supporting the pressing portion;

the retainer member being pivotally mounted on the pole, and comprising:

a retainer plate mounted at an intermediate point thereof directly to said pole for pivotal movement relative thereto, said plate being formed in a convexly curved shape about said intermediate point, so as to extend away from said pole and having a retainer surface in contact with the ironed substance above the intermediate point; and an elastic member coupled between the retainer plate and the pole providing a force to urge the retainer plate away from the pole, whereby the retainer surfaces urge toward the pressing portion.

19. An ironing board in accordance with claim 18, further comprising an auxiliary pressing portion detachably mounted on the pressing portion and having a generally hemispherical convex face portion.

20. The ironing board according to claim 19, wherein the pressing portion includes a hook, and the auxiliary pressing portion includes a latching portion adapted to be engaged with the hook.

21. The ironing board according to claim 20, wherein the auxiliary pressing portion has the convex face portion and a flat reverse portion and is formed in a bag shape with one side apertured.

22. The ironing board according to claim 19, wherein the auxiliary pressing portion has the convex face portion and a flat reverse portion and is formed in a bag shape with one side apertured.

23. An ironing board comprising:

a pressing portion having a pressing surface for contacting the ironed substance;

a pole disposed below the pressing portion for supporting the same; and a retaining member detachably mounted to the pole for restraining part of the ironed substance against the pressing portion, comprising:

a pair of opposed mounting legs spaced at a distance permitting them to straddle the pole, the legs being constructed to engage and detachably retain the retainer member on the pole;

a resilient neck portion extending away from and above the pole, the resilience of the neck portion urging it towards the pressing portion; and a retainer surface near the top of the neck portion positioned to contact and retain an ironed substance which is placed on the pressing surface by virtue of the resilience of the neck portion.

* * * * *